US006598777B2

(12) United States Patent
Osuga et al.

(10) Patent No.: US 6,598,777 B2
(45) Date of Patent: Jul. 29, 2003

(54) CONNECTED NAIL SUPPLYING MECHANISM FOR NAILING MACHINE

(75) Inventors: Satoshi Osuga, Tokyo (JP); Mitsugu Takezaki, Tokyo (JP); Michiaki Adachi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 91 days.

(21) Appl. No.: 09/987,947

(22) Filed: Nov. 16, 2001

(65) Prior Publication Data

US 2002/0060234 A1 May 23, 2002

(30) Foreign Application Priority Data

| | | |
|---|---|---|
| Nov. 16, 2000 | (JP) | 2000-349266 |
| Jan. 23, 2001 | (JP) | 2001-014277 |
| Jan. 23, 2001 | (JP) | 2001-014278 |
| Sep. 27, 2001 | (JP) | 2001-297333 |

(51) Int. Cl.[7] ..... B25C 1/04

(52) U.S. Cl. ..... 227/136; 227/119; 227/120; 227/127; 227/138

(58) Field of Search ..... 227/116, 119, 227/120, 136, 138, 126, 127, 135, 128

(56) References Cited

U.S. PATENT DOCUMENTS

| | | | | |
|---|---|---|---|---|
| 3,266,697 A | * | 8/1966 | Fiedler | 227/120 |
| 3,437,249 A | * | 4/1969 | Baum | 227/120 |
| 4,558,811 A | * | 12/1985 | Klaus | 227/116 |
| 4,784,306 A | * | 11/1988 | Baum | 227/120 |
| 5,626,274 A | * | 5/1997 | Shkolnikov et al. | 227/136 |
| 6,499,642 B1 | * | 12/2002 | Amada | 227/119 |

FOREIGN PATENT DOCUMENTS

| | | |
|---|---|---|
| JP | 59-209772 | 11/1984 |
| JP | 2-269581 | 11/1990 |

OTHER PUBLICATIONS

U.S. patent application No. 09/954,150, filed Sep. 18, 2001.

* cited by examiner

*Primary Examiner*—Scott A. Smith
(74) *Attorney, Agent, or Firm*—Morgan, Lewis & Bockius LLP

(57) ABSTRACT

A magazine includes a nail guide surface and a movable guide wall. The nail guide surface is linear and continuous to a nail introducing opening and has a shoulder for supporting the nail heads of a connected nail assembly. The movable guide wall is confronted with the nail guide surface. In the magazine, a plurality of connected nail assemblies are loaded and placed in side-by-side relation, while being in contact with each other, between the nail guide surface and the movable guide wall. The plurality of connected nail assemblies are pressed against the guide surface of the magazine by pressing members provided on the movable guide wall. The movable guide wall is turned, for opening and closing, between a position being confronted with the nail guide surface of the magazine and a position at which the nail guide surface is opened.

14 Claims, 30 Drawing Sheets

CONNECTED NAIL SUPPLYING MECHANISM FOR NAILING MACHINE

BACKGROUND OF THE INVENTION

1. Field of the Invention

The present invention relates to a connected nail supplying mechanism for a nailing machine, which successively supplies connected nail assemblies to a nail ejection part thereof, from a magazine which contains a plurality of connected nail assemblies, each connected nail assembly consisting of a series of nails, which are arranged in side-by-side relationship and connected together by a synthetic resin or paper tape.

2. Description of the Related Art

A connected nail assembly including a number of interconnected nails is generally used for a nailing machine which is powered by a compressed air or the like. Depending on the type of nail connection, the connected nail assembly is categorized into two known types. One is a coiled connected nail assembly in which a number of nails are connected by a flexible coupling member and rolled into a coil shape, and the other is a linear connected nail assembly in which nails are connected by a coupling member whose rigidity is large. A nailing machine using the coiled connected nail assembly needs a cylindrical magazine for accommodating nails therein. Normally the cylindrical magazine is wider than a main body of the nailing machine tool. This wider magazine is disposed near a nose portion of the machine as a nail ejection portion. Accordingly, the magazine thus disposed makes it difficult for the user to view a nail driving position when the nailing machine is operated and operatability is deteriorated.

In the nailing machine using the linear connected nail assembly in which nails are linearly arranged and connected, the width of the magazine containing the connected nail assemblies may be reduced. Accordingly, the nailing machine has an advantage that a driving position is easily viewed from a side of the magazine; hence the operatability is improved. In the linear connected nail assembly, the number of nails of the linear connected nail assembly for each unit is smaller than that in the coiled connected nail assembly. Accordingly, it is necessary to frequently replenish the connected nail assemblies to the magazine. A nailing machine designed so as to lessen the work for replenishing a connected nail assembly is also known. A magazine of the machine is long so as to accommodate a number of linear connected nail assemblies in a series fashion. The long magazine, when mounted, projects long to the rear side of the nailing machine main body. This makes it difficult to handle the nailing machine, and the operatability is impaired. The linear magazine employs a mechanism in which a connected nail assembly having been loaded into the magazine is pushed toward the nose portion by pressing the trailing end of the connected nail assembly. Where a number of connected nail assemblies are loaded into the long magazine, a pressing force of the compressed spring, a fixed output spring or the like decreases, so that the nail supplying is unreliable.

To solve the above problems of the magazine containing a plurality of linear connected nail assemblies, there is proposed a linear-connected nail assembly magazine and feeding mechanism in which a plurality of linear connected nail assemblies are juxtaposed in the magazine, and a plurality of linear connected nail assemblies are successively supplied to the driving portion. A related technique is disclosed in JP-A-59-209773. According to the disclosure in JP-A-59-209773, the connected nail supplying mechanism includes a fixed guide wall formed continuous to a nose part forming a nail ejection opening, a nail supplying path defined by a movable guide wall, which is movable with respective to the fixed guide wall in an opening/closing manner, and a box type magazine, located on the rear side of the nail supplying path, in which a plurality of connected nail assemblies are placed in side-by-side relation. In the connected nail supplying mechanism, the connected nail assemblies that are pressed against a guide surface being flush with the fixed guide wall are successively supplied to the nail ejection opening, through the reciprocating motion of a nail feeding member along the fixed guide wall.

The technique of JP-A-59-209773 uses a box-type magazine wide enough to accommodate two or more number of connected nail assemblies being arrayed in side-by-side relation. Within the magazine, the connected nail assemblies are pressed against the fixed guide wall that is provided along one side of the magazine. Those connected nail assemblies are successively thrust to the nail ejection portion, through an opening formed in the front end of the fixed guide wall. The connected nail assemblies having been pressed against the fixed guide wall within the magazine are brought into engagement with the feeding member, which are reciprocatively moved along the fixed guide wall, and are fed out through the opening. In the mechanism, the connected nail assembly on the fixed guide wall is pressed between the fixed guide surface and the connected nail assembly adjacent thereto by the pressing force. As a result, a resistance for impeding the feeding of the connected nail assembly is considerably large, and there is a great possibility that the interference with the adjacent connected nail assembly makes it impossible for the feeding member to feed the connected nail assembly. Therefore, measures have been taken for avoiding the interference of the adjacent connected nail assemblies. In a measure, the heads of the connected nail assemblies are put in the guide grooves formed within the magazine and guided so as to maintain a large space between the connected nail assemblies. In another measure, a thickness of a connecting strip which integrally connects the nails is increased, and the connecting strips are brought into contact with each other or the connecting strip is brought into contact with the nail shank, thereby increasing the space between the connected nail assemblies. However, in these measures, additional problems arise such that the size and weight of the magazine, and cost to manufacture are increased since the space between the connected nail assemblies within the magazine is large.

Further, in the conventional magazine according to JP-A-59-209773, pressing means is provided which presses a plurality of connected nail assemblies located within a box type magazine against the guide surface. The connected nail assemblies within the magazine are constantly pressed by the pressing means. To load the connected nail assembly into the magazine, the connected nail assembly is inserted into the magazine, through an opening formed in the rear end of the magazine. In this case, a loading resistance of the connected nail assembly is large because of presence of the urging force by the urging means. Accordingly, it is difficult to fully load the connected nail assembly up to the loading position (at which the foremost nail of the connected nail assembly is placed at the front end of the magazine). Particularly, when the connected nail assembly is pulled out of the magazine during the nailing operation and the number of nails contained in the connected nail assembly is reduced, the foremost nail of the connected nail assembly is located at a position before the loading position.

In this state, the connected nail assembly is out of the reciprocating operation range of the feeding member. Accordingly, there is a chance that after the preceding connected nail assembly is used up, the supply of the subsequent connected nail assembly is impossible.

On the other hand, there is proposed a nailing machine as disclosed in JP-A-2-269581. In the proposal, a plurality of connected nail assemblies are put in a magazine, and those connected nail assemblies are successively supplied to a nail ejection part. The proposal succeeds in reducing the number of operations for replenishing a connected nail assembly.

The conventional art according to JP-A-2-269581 as a connected nail supplying mechanism includes a fixed guide wall formed continuous to a nose portion forming a nail ejection opening, a nail supplying path defined by a movable guide wall, which may be turned with respect to the fixed guide wall in an opening/closing manner, and a box type magazine, located on the rear side of the nail supplying path, in which a plurality of connected nail assemblies are placed in side-by-side relation. In the connected nail supplying mechanism of the conventional art, the connected nail assemblies disposed along the fixed guide wall are successively supplied to the nail ejection opening of the nose portion, through the reciprocating motion of a nail feeding member which has been advanced into the nail supplying path. The connected nail supplying mechanism includes a connected nail assembly pressed against a fixed guide surface, which is spaced from a nail supplying path surface of the fixed guide wall by a predetermined distance, a separator member which is movable between the adjacent nails of the connected nail assemblies, and a feeding clamp which is provided on the fixed guide wall and urged into the nail supplying path. The connected nail assembly is clamped with the feeding clamp and supplied to the nail ejection opening. Additionally, a check pawl for checking the reverse movement of the connected nail assembly is urged, by means of a spring, to advance to the nail supplying path, from the fixed guide wall.

As discussed above, JP-A-2-269581 discloses another technique. In the technique, a separator which operates interlocking with the nail feeding member is thrust to between the connected nail assembly pressed against the fixed guide wall and the connected nail assembly adjacent thereto within the box type magazine, thereby eliminating the trouble, e.g., the increase of the strip feeding resistance caused by the interference between the connected nail assemblies. However, the separator, together with the feeding member, must be driven so that it advances into the magazine from the front outside of the box type magazine. This results in complexity of the structure, and hence will cause troubles and increase the cost to manufacture.

In the conventional art, the magazine must be shaped like a box and have a fixed width in order to accommodate a plurality of connected nail assemblies, and the thus configured magazine accommodates a plurality of connected nail assemblies. In the connected nail assembly used for this type of a nailing machine, a number of nails are generally connected in a state that those are arranged on a plane and the heads of the nails overlap. Where the connected nail assemblies loaded are placed in side-by-side relation within the magazine, the nail heads of the adjacent connected nail assemblies overlap and come in engagement with each other. As a result, the movement of the connected nail assemblies in the nail feeding direction is interrupted. For this reason, the width of the connecting strip is increased or the separator is advanced between the connected nail assemblies as disclosed in the conventional art, thereby preventing the interference between the nail heads of the connected nail assemblies. Thus, in the conventional magazine, the width dimension of the magazine is large, the related mechanism is complicated, and the weight thereof is increased.

Specifically, in the conventional art according to JP-A-2-269581, the separator and the feeding clamp, which cooperatively operate, are confronted with each other with the nail supplying path being interposed therebetween. The feeding clamp, together with the separator, is mounted on the nail feeding drive mechanism. The feeding clamp is urged, by a spring force, so as to be brought into close contact with the separator by a spring force. Accordingly, even in a state that the movable guide wall is put in an open state, the feeding clamp clamps the connected nail assembly in the nail supplying path, and it checks the backward movement of the connected nail assembly. For this reason, in a case where, during the nailing work, the connected nail assembly currently used is replaced with another connected nail assembly different in size from that of the former, in order to remove the connected nail assembly staying in the nail supplying path, the user must pull backward the connected nail assembly in a state that the feeding clamp and the check pawl are retracted from the nail supplying path while resisting the spring urging force. For the removal of the connected nail assembly, the nailing machine must be put on a stable place, and both hands must be used. Therefore, it is impossible to replace the connected nail assembly with another at an unstable place, e.g., nailing scaffold.

SUMMARY OF THE INVENTION

Accordingly, a first object of the present invention is to provide a connected nail supplying mechanism for a nailing machine which allows the user to simply make the replacement and replenishment of a connected nail assembly even during the nailing work.

Further, a second object of the present invention is to provide a nail supplying mechanism for a nailing machine, which does not need a box type magazine whose weight is indispensably large, allows a plurality of connected nail assemblies to be loaded into the magazine with the nail heads of them overlapping with each other, allows the space between the loaded connected nail assemblies to be reduced, and is capable of successively supplying a plurality of connected nail assemblies to the nail driving portion.

Accordingly, a third object of the present invention is to provide a connected nail supplying mechanism for a nailing machine which enables the user to reliably load the connected nail assembly into the magazine even if the number of nails in the connected nail assembly is smaller than a prescribed one.

To achieve the above first object, there is provided a nailing machine having a nose portion including a nail ejection opening, which slidably receives a driver powered by a compressed air or the like, and a magazine loaded with connected nail assemblies. The machine drives out, by the driver, nails that are fed from the magazine to the nail ejection opening through a nail introducing opening formed in a side surface of the nail ejection opening. The nailing machine is characterized by a nail supplying mechanism in which the magazine includes a linear nail guide surface being continuous to the nail introducing opening and having a shoulder for supporting the nail heads of the connected nail assembly, and a movable guide wall being confronted with the guide surface. In the magazine, a plurality of connected nail assemblies are loaded and placed in side-by-side relation, while being in contact with each other, between the nail guide surface and the movable guide wall. The plurality of connected nail assemblies are pressed against the guide surface of the magazine by means of a pressing portion provided on the movable guide wall. The movable guide wall is turned, for opening and closing, between a position being confronted with the nail guide surface of the magazine and a position at which the nail guide surface is opened.

Further, to achieve the above second object, there is provided a nail supplying mechanism in which a magazine having a linear nail guide surface which is continuous to a nail introducing opening and includes a shoulder for supporting the nail heads of a connected nail assembly, and a pressing portion for pressing against the nail guide surface of the magazine, a plurality of connected nail assemblies being loaded and placed in side-by-side relation, while being in contact with each other, along the nail guide surface of the magazine, are both confronted with the nail guide surface of the magazine.

Further, according to the invention, there is provided a nail supplying mechanism in which a magazine having a linear nail guide surface which is flush with the fixed guide surface and continuous to a nail introducing opening. The guide surface of the magazine includes a shoulder extending to the connected nail assembly feeding direction, the shoulder being for supporting the lower side of the nail heads of a first connected nail assembly disposed along the guide surface, and a pressing portion elastically presses the first connected nail assembly disposed along the guide surface and a second connected nail assembly loaded and placed in side-by-side relation against the fixed guide surface. The pressing portion is confronted with the guide surface of the magazine, and the pressing portion includes a head-supporting member for supporting the lower side of the nail heads of the second connected nail assembly.

Further, according to the invention, there is provided a nail supplying mechanism in which the rear end of the pressing portion is positioned ahead the rear end of the magazine.

Additionally, according to the invention, there is provided a nail supplying mechanism which further includes:

a nail feeding member which passes through the fixed guide wall of the nose portion to advance to the fixed guide surface, and is reciprocatively moved, and engages the individual nails of connected nail assembly disposed along the fixed guide surface and supplies the individual nails to the nail ejection opening;

a check member engaging the nails of the connected nail assembly disposed along the fixed guide surface to block the backward movement of the connected nail assembly, the check member including a seizing pawl member engaging the nails of the second connected nail assembly to block the backward movement of the second connected nail assembly, thereby seizing and holding the second connected nail assembly at the loading position wherein the seizing pawl member is located ahead the rear end of a reciprocating stroke of the nail feeding member; and a stopping face for stopping the second connected nail assembly at a position at which the nail shank of the first nail of the second connected nail assembly is positioned ahead of the seizing pawl member.

According to the invention, there is provided a nail supplying mechanism which further includes:

an opening/closing guide member being supported on the nose portion in an opening/closing fashion, and confronted with the fixed guide surface of the nose portion; and a magazine cover being supported on the magazine in an opening/closing fashion behind the opening/closing guide member, and confronted with the fixed guide of the magazine;

wherein the pressing portion are provided on the opening/closing guide member and the magazine cover, and the seizing pawl member is provided on the pressing portion of the opening/closing guide member.

Furthermore, according to the invention, there is provided a nail supplying mechanism, wherein the pressing portion is divided into a pressing member which comes in contact with the nail shank of the connected nail assembly and presses the connected nail assembly to the fixed guide surface and a head-supporting member for supporting the nail heads of the second connected nail assembly when engaging the under side of the nail heads of the second connected nail assembly, and wherein an operation stroke of the head-supporting member moving to the fixed guide surface is restrictively selected, and a slanted guide surface is provided above the nail heads of the first and second connected nail assemblies loaded, and wherein when the second connected nail assembly is pressed and moved to the fixed guide surface, the support of the under side of the nail heads by the head-supporting member is removed, and the connected nail assembly is guided downward by the slanted guide surface.

Further, to achieve the above third object, there is provided a connected nail supplying mechanism. In the connected nail supplying mechanism, a magazine includes a nail guide surface which is continuous to a nail introducing opening and a shoulder for supporting the nail heads of the connected nail assembly, and is loaded with a plurality of connected nail assemblies in a state that the connected nail assemblies are disposed in side-by-side relation along the nail guide surface while being in contact with each other. A movable guide wall having a pressing portion for pressing the connected nail assembly against the nail guide surface is confronted with the nail guide surface of the magazine. A cutout is formed in a guide wall of the magazine, while extending from the rear end of the magazine to be loaded with the connected nail assembly to a nail ejection opening.

In the connected nail supplying mechanism, a recess is formed in the nail guide surface of the magazine, while extending from the rear end to the magazine, and the user may insert his finger into the recess. Therefore, even the connected nail assembly whose length is short may be pushed into the inner part of the magazine.

BRIEF DESCRIPTION OF THE DRAWINGS

FIG. 16(*a*) shows a state that only a first connected nail assembly is loaded, and FIG. 16(*b*) shows a state that first and second connected nail assemblies are loaded.

FIG. 18(*a*) shows a state that only a first connected nail assembly is loaded, and FIG. 18(*b*) shows a state that first and second connected nail assemblies are loaded.

DETAILED DESCRIPTION OF THE PREFERRED EMBODIMENTS

Figure 1:
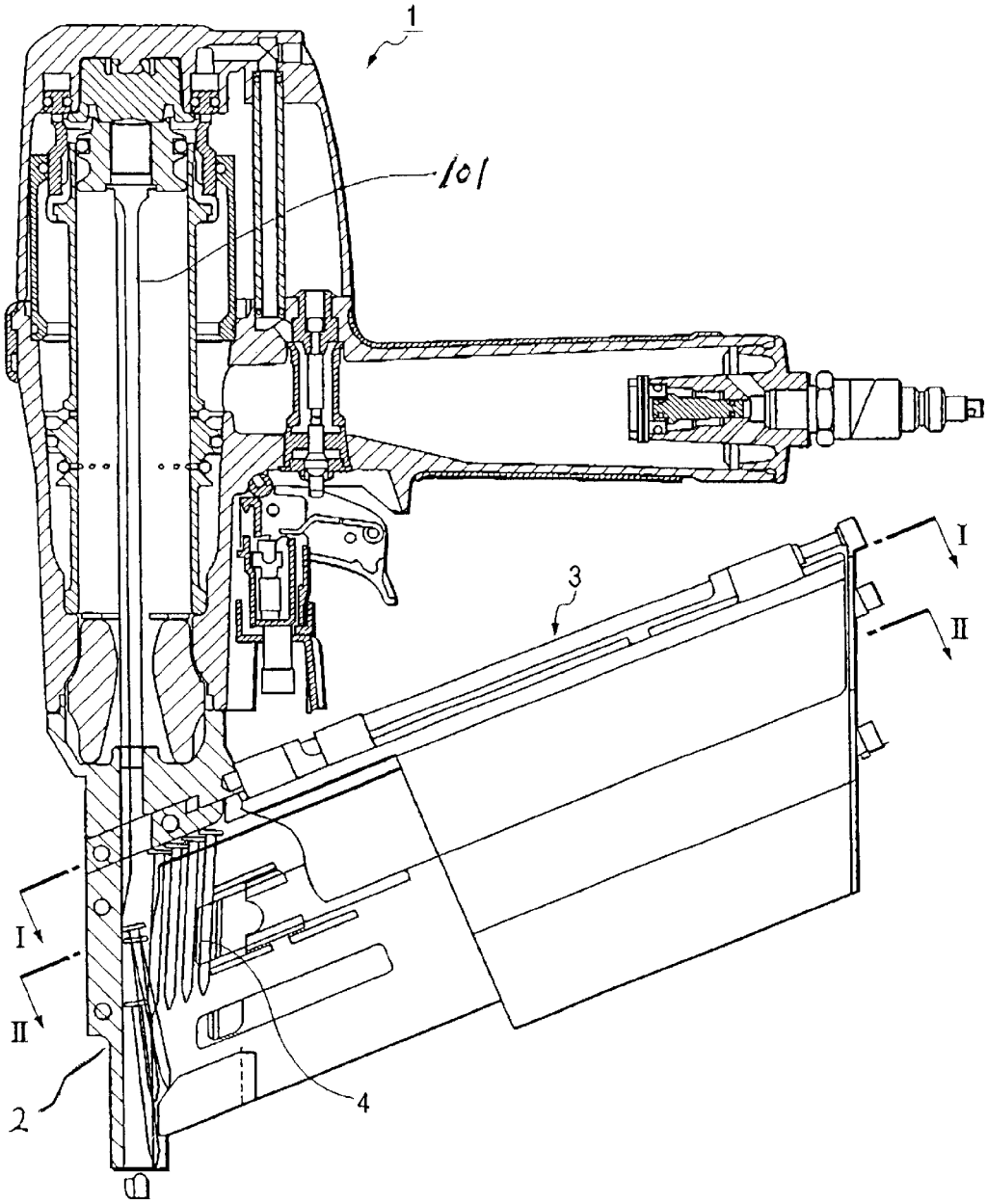
FIG. 1 is a side view showing a low part of a nailing machine constructed according to the present invention.
Figure 2:
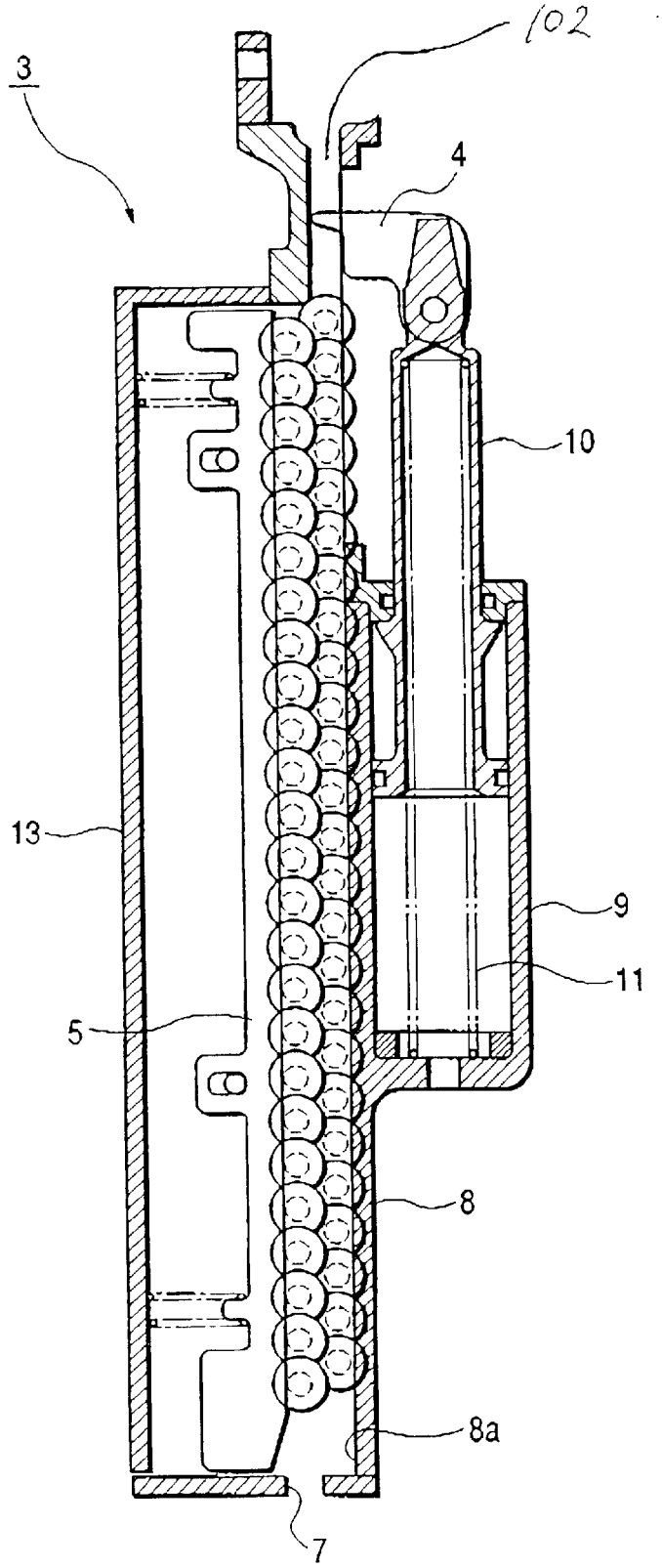
FIG. 2 is a cross sectional view taken on line I—I in FIG. 1.
Figure 3:
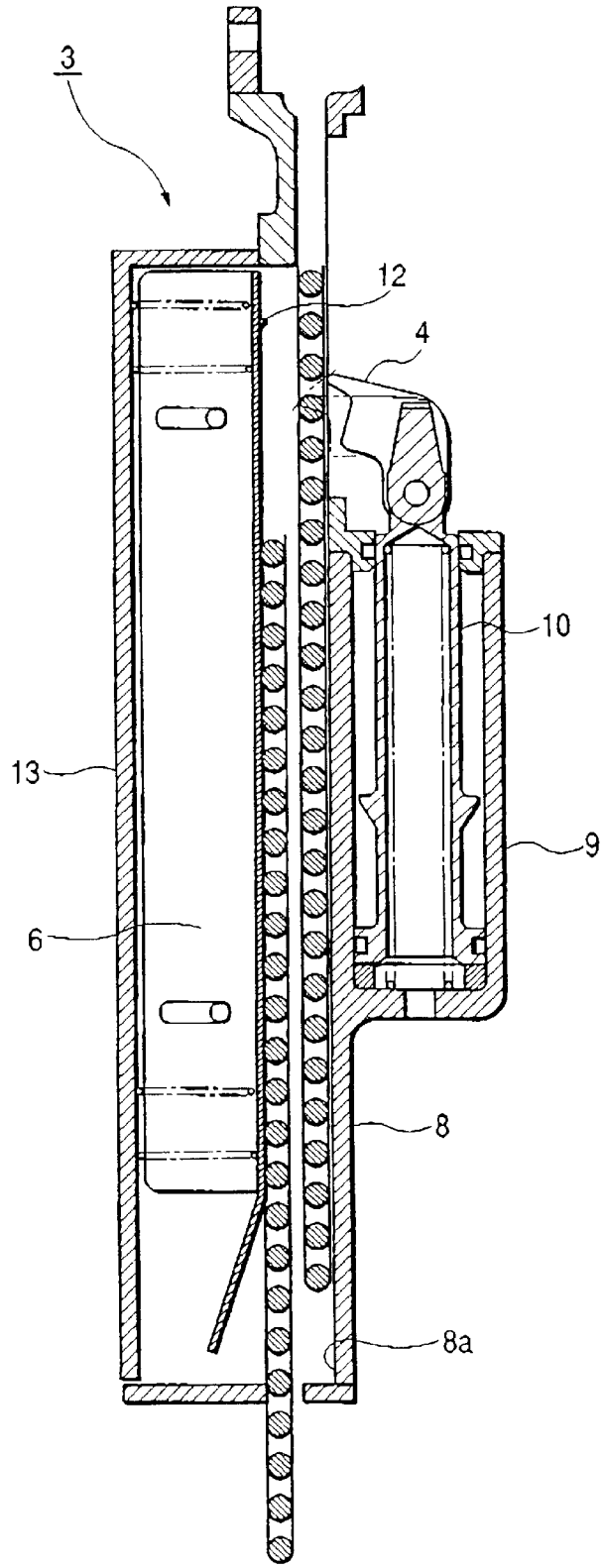
FIG. 3 is a cross sectional view taken on line II—II in FIG. 1.
Figure 4:
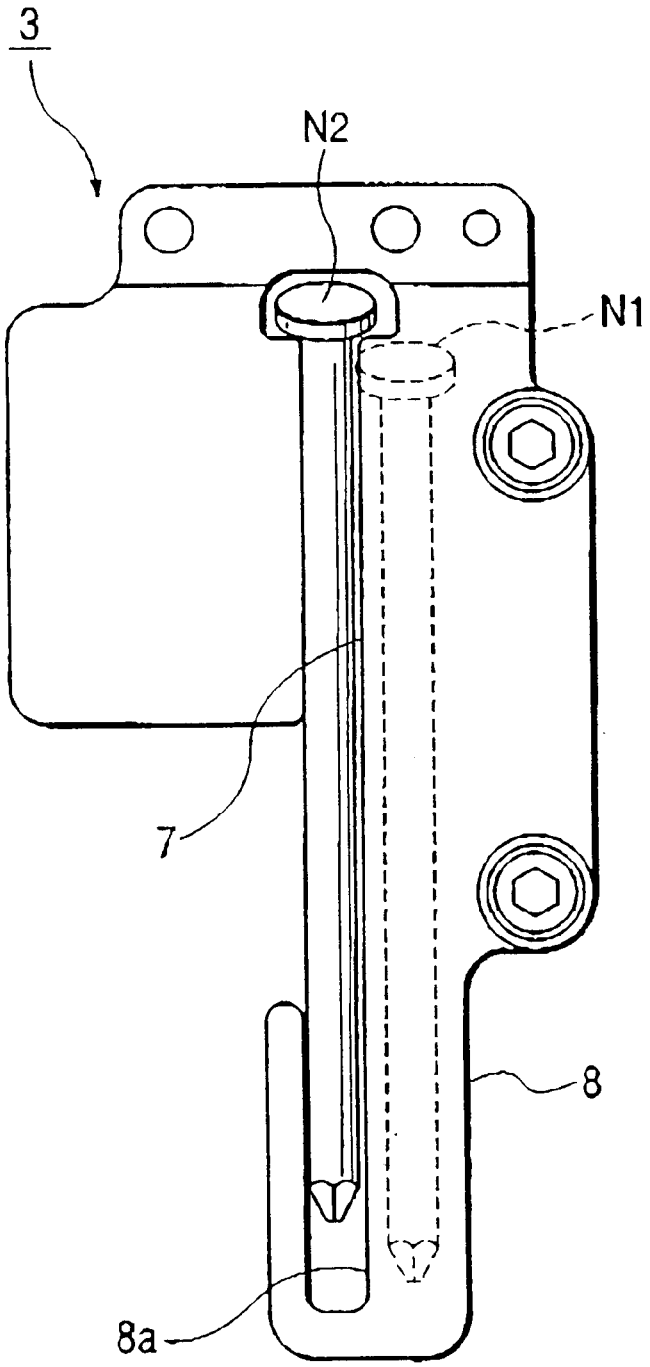
FIG. 4 is a cross sectional view taken on line III—III in FIG. 1.

FIG. 1 is a side view showing a low part of a nailing machine constructed according to the present invention. FIG. 2 is a cross sectional view taken on line I—I in FIG. 1. FIG. 3 is a cross sectional view taken on line II—II of FIG. 1. FIG. 4 is a cross sectional view taken on line III—III of FIG. 1.

In the figures, reference numeral 101 designates a nose portion. The nose portion 101 is provided at the front end of a main body (not shown) of a nailing machine, and includes a nail ejection opening 102*a* which slidably contains a driver 102 to be driven by compressed air or the like in the nailing machine main body (machine main body). A connected nail assembly 104, which has been loaded into a magazine 103, is fed to a nail ejection opening 102*a*, and driven out through the tip of the nose portion 101 by means of the driver 102. The connected nail assembly 104 consists of a series of nails being linearly arrayed in straight.

A nail introducing opening 105, as shown in FIG. 2, is formed in a side of the nail ejection opening 102*a*. A nail guide surface 106 (a planar shape) is extended linearly and continuously from the nail introducing port 105. The nail guide surface 106 includes a shoulder 107 (see FIG. 3) for supporting nail heads of the connected nail assembly 104.

A door 108 (opening/closing guide member) and a movable guide wall 109 are oppositely disposed with respect to the nail guide surface 106, while being separated from each other by a predetermined distance.

The door 108 of the known type, as shown in FIGS. 2 and 4, is supported on a shaft 110 disposed along the nose portion 101, in a state that it is horizontally turned about the shaft. A first pressing member 111, which is divided into upper and lower parts, is disposed on the inner side of the door, and is urged and pressed against the nail guide surface 106 by means of a spring 112. Reference numeral 113 is a check pawl. A slanted guide portion 114 is provided on a rear part of the first pressing member 111.

The movable guide wall 109 is disposed on a front part of a magazine main body 103*a*, while being adjacent to the door 108. The movable guide wall, as shown in FIG. 3, may vertically be turned about a support shaft 115, which is disposed in an upper part of the magazine main body 103*a*. A second pressing member 116 is disposed on the inner side, and urged and pressed against the nail guide surface 106 by means of a spring 117. A slanted guide portion 118 is provided on a rear part of the second pressing member 116. A second head-supporting member 116*a* for supporting the nail heads of the connected nail assembly 104 is formed on the second pressing member 116.

Accordingly, the door 108 and the movable guide wall 109, together with the pressing members 111 and 116, are respectively turned, for opening and closing, about the shafts 110 and 115 between a position opposed to the nail guide surface 106 of the magazine 103 and a position at which the nail guide surface 106 is open. The door 108 and the movable guide wall 109 may mutually be locked with locking means 124, and are not opened till the locking state is removed.

Figure 5:
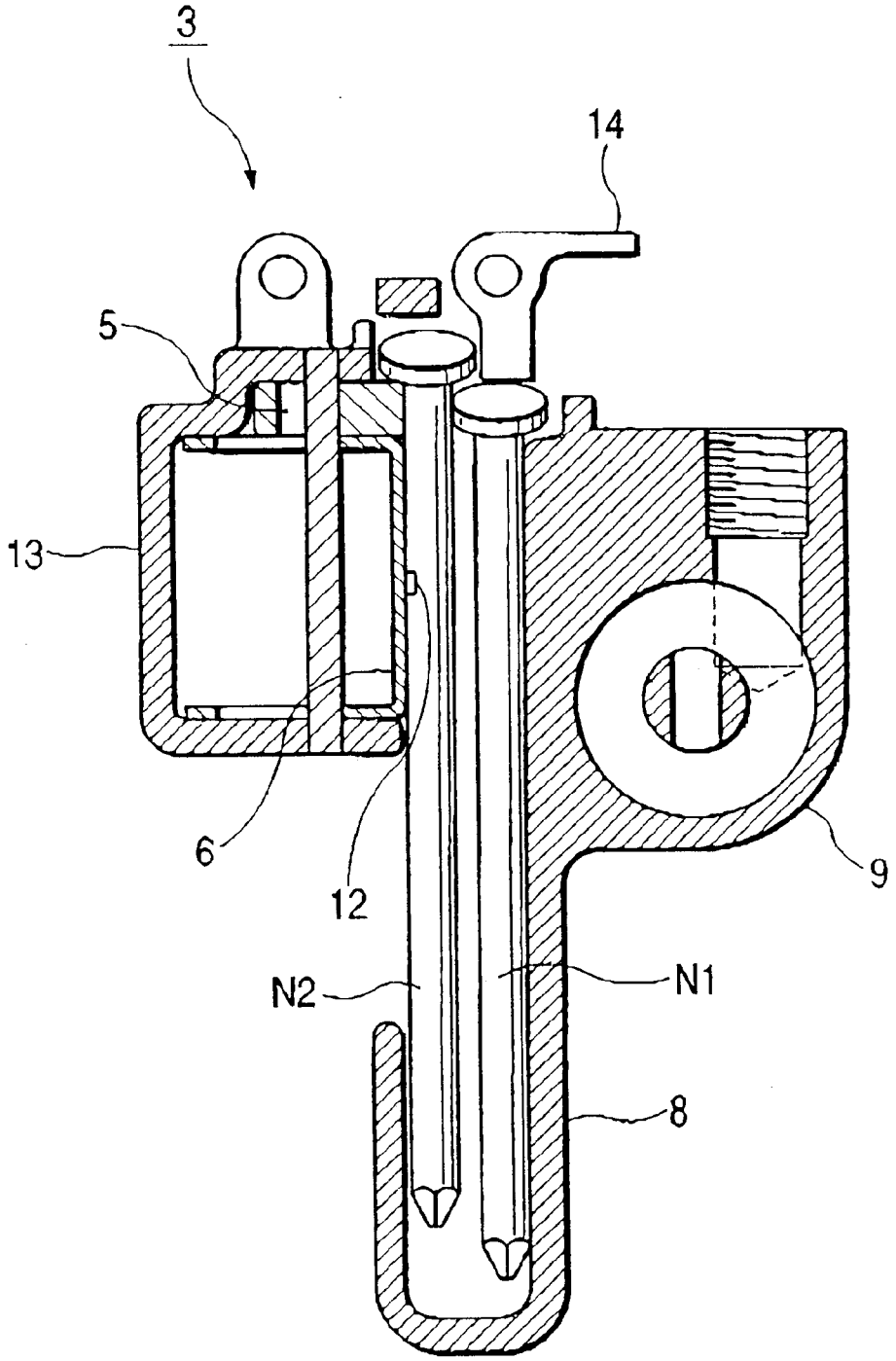
FIG. 5 is a view showing a loading of a connected nail assembly into the nailing machine.
Figure 6:
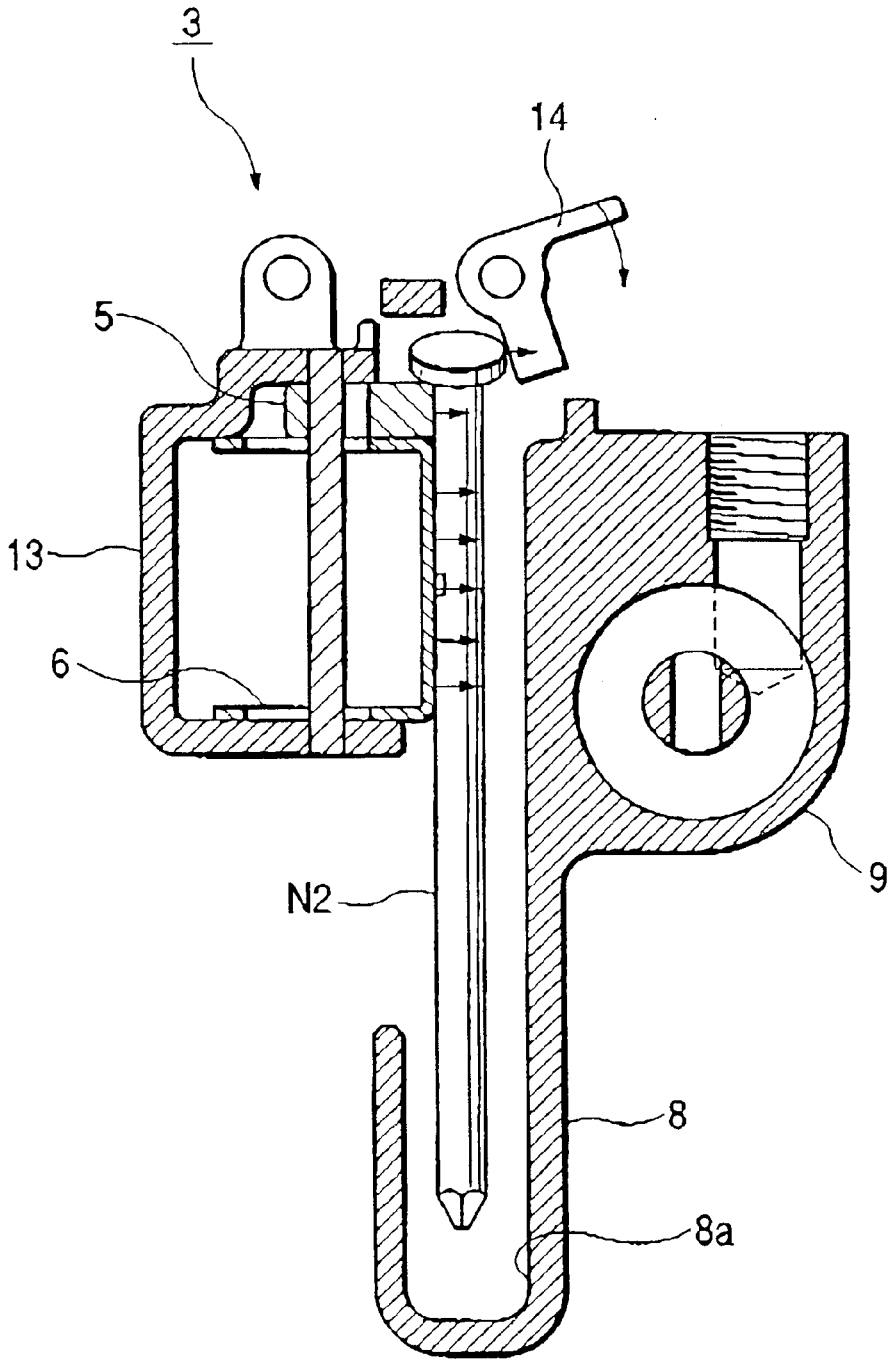
FIG. 6 is a cross sectional view showing a state that no connected nail assembly is loaded into the magazine.
Figure 7:
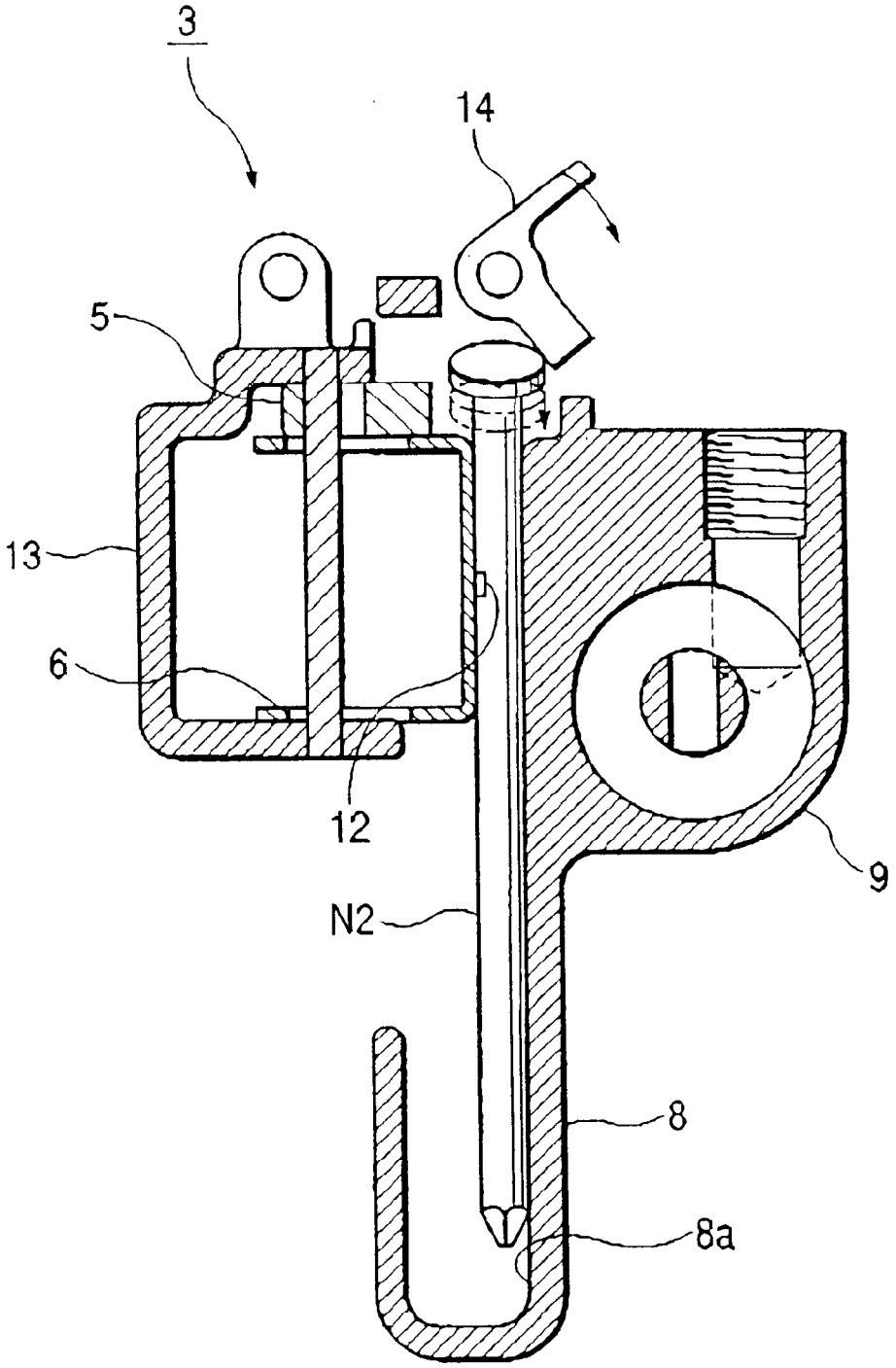
FIG. 7 is a cross sectional view showing a state that one connected nail assembly is loaded into the magazine.

To load the connected nail assembly 104 into the thus constructed magazine 103, the connected nail assembly is inserted into the magazine 103, from the rear end of the magazine as shown in FIG. 5. In the loading, the front end of the connected nail assembly 104 hits the slanted guide portion 118 on the rear end of the pressing member of the movable guide wall 109. As shown in FIGS. 3, 6 and 7, it presses back the second pressing members 116 and advances into the magazine. Also for the door 108, it may be loaded along the nail guide surface 106 while pressing back the first pressing member 111. Within the magazine 103, two connected nail assemblies 104 are juxtaposed in a state that the heads of those connected nail assemblies 104 partially overlap as shown in FIGS. 2 and 3. The heads of those connected nail assemblies 104 are slidably supported on the shoulders 107 and the second head-supporting member 116*a*, which are formed on the nail guide surface 106 and the movable guide wall 109. The pressing members 111 and 116, which are located closer to the door 108 and the movable guide wall 109, support the connected nail assembly 104 while pressing them to the nail guide surface 106. In this sense, the pressing members 111 and 116 form pressing means for the connected nail assembly 104.

A nail feeder 120, as shown in FIG. 2, is disposed on the rear side of the nail guide surface 106. The nail feeder 120 includes a nail feeding member 121 for feeding the connected nail assembly 104 toward the nail introducing port 105. The nail feeding member 121 is reciprocatively movable in a nail feeding direction. The tip end 121*a* of the nail feeding member 121 passes through the nail guide surface 106 from the rear side of the nail guide surface, and advances through the inner side, and engages with the nail shank of the connected nail assembly 104 on the side of nail guide surface 106. The nail feeder 120 may be of the known type in which the nail feeding member 121, which is pivotally coupled to a piston rod 122, is reciprocatively moved by a piston/cylinder mechanism utilizing a compressed air. On the nail guide surface 106, a check pawl 123 is provided for preventing the connected nail assembly 104 from moving apart from the nail introducing port 105.

In the nail feeder 120, the piston moves forward; the nail feeding member 121 comes in engagement with the nail shank of the connected nail assembly 104 located closer to the nail guide surface 106; feeds the nail to the nose portion side; and feeds the foremost nail of the connected nail assembly 104 to the nail introducing opening 105 (a state shown in FIG. 2). When the nail feeding member 121 moves backward, the nail feeding member disengages from the connected nail assembly 104 and returns to is initial position. Accordingly, the foremost nail of the connected nail assembly 104 is moved to the nail introducing port 105 every movement of the piston back and forth. When the connected nail assembly 104 located closer to the nail guide surface 106 is fed to the last, the other connected nail assembly 104 is pressed by the pressing members 111 and 116 to slide toward the nail guide surface 106, and this connected nail assembly 104 is driven successively.

Figure 8:
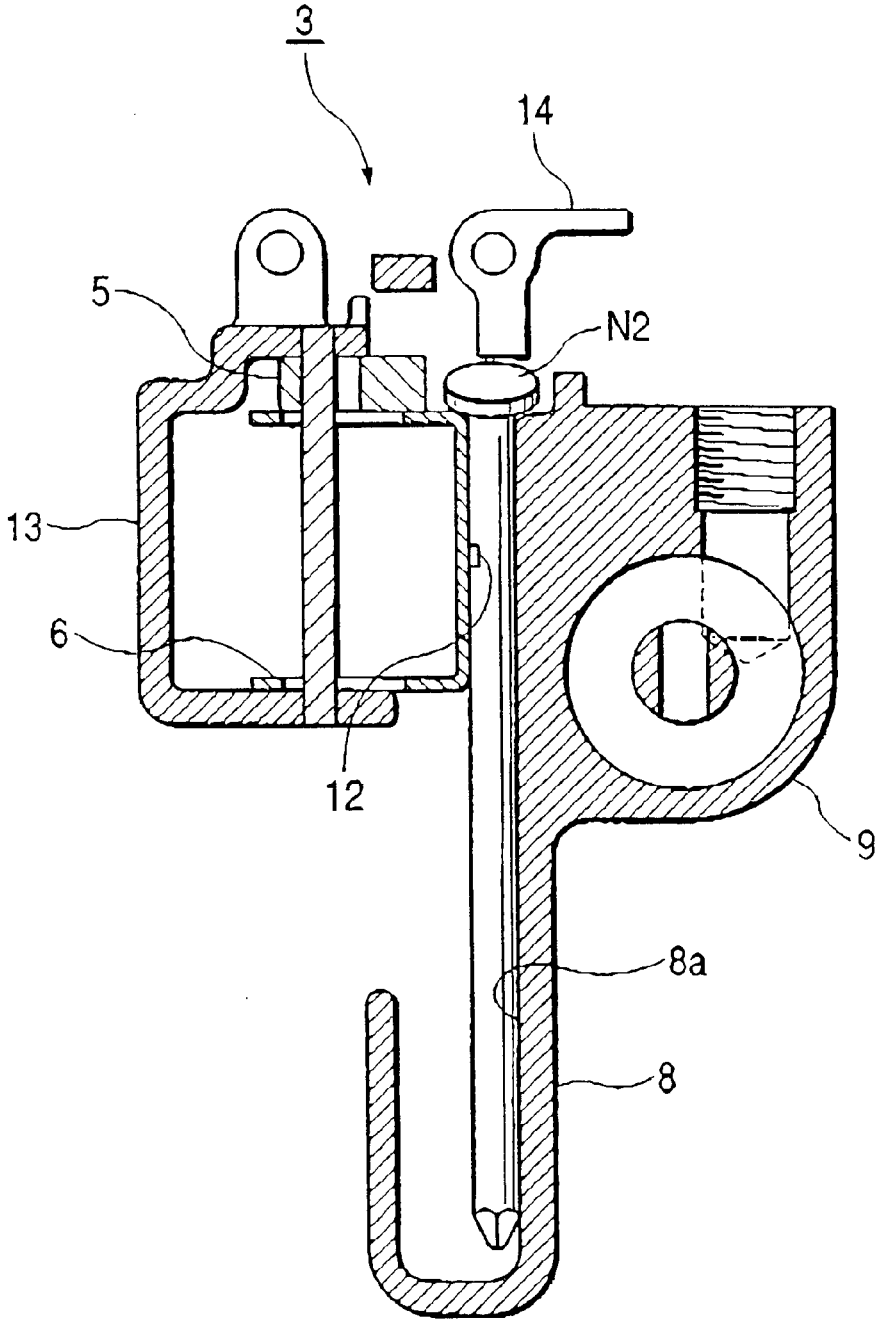
FIG. 8 is a cross sectional view showing a state that a movable guide wall is turned apart from the magazine.

In a case when replacing the current connected nail assembly with another connected nail assembly whose size is different from the former during the nailing work, the connected nail assembly 104 located closer to the nail guide surface 106 is removed as shown in FIG. 8, the movable guide wall 109 (and the door 108) is turned about the support shaft 115 (110) to open the magazine 103, and the user accesses the remaining connected nail assembly 104 through the opened place, and manually pulls the connected nail assembly to the rear side of the magazine 103, and out of there.

Figure 9:
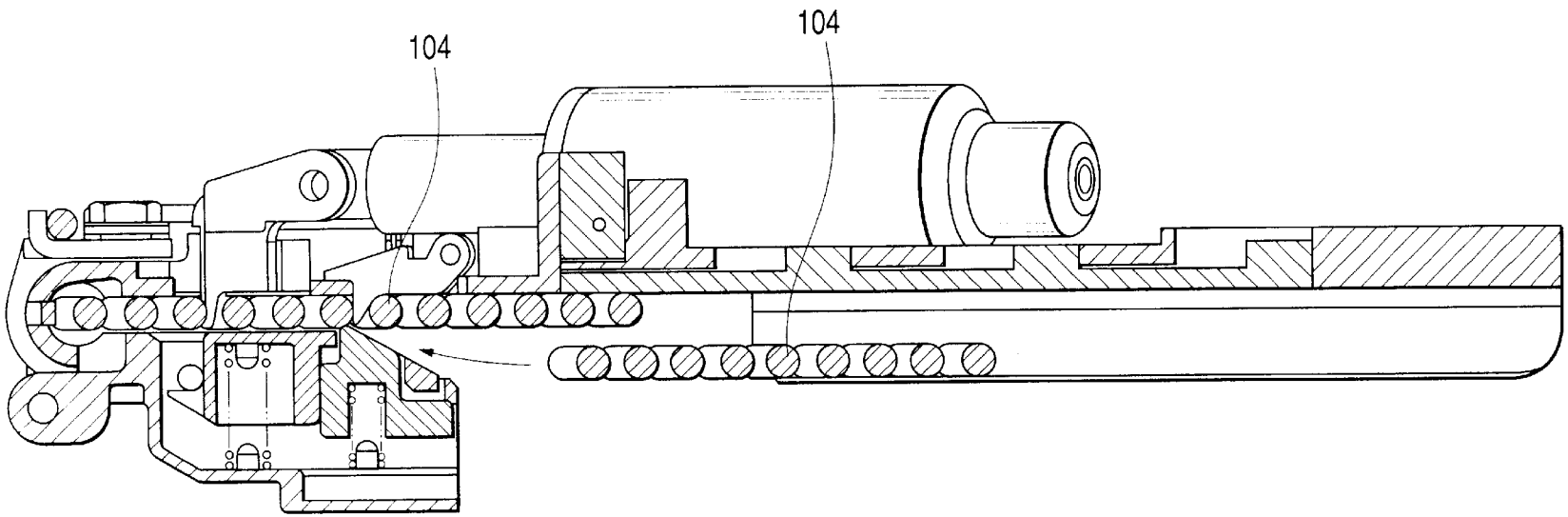
FIG. 9 is a cross sectional view showing a state that a second connected nail assembly is being replenished into the magazine.
Figure 10:
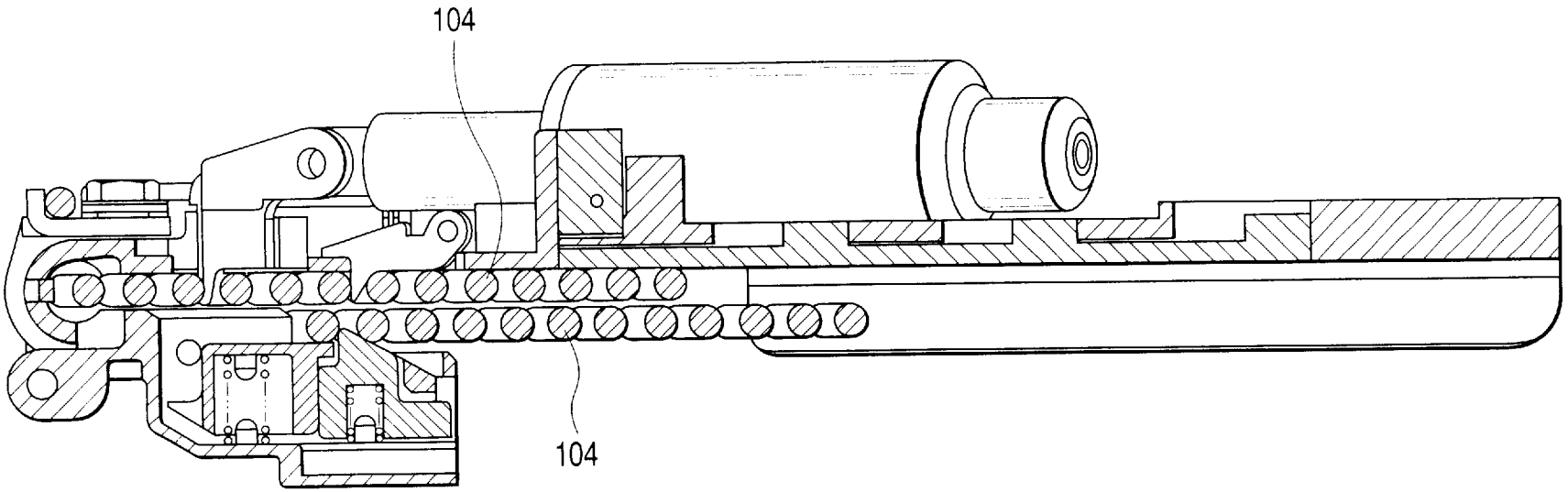
FIG. 10 is a cross sectional view showing a state that a second connected nail assembly has been replenished into the magazine.

When the remainder of the connected nail assembly 104 located close to the nail guide surface is reduced in amount, and a new connected nail assembly is loaded and placed close to the one, the movable guide wall 109 is opened and the new connected nail assembly 104 is loaded and placed close to the side of the old one 104, as shown in FIGS. 8, 9 and 10. After loading, the movable guide wall 109 is closed as shown in FIG. 2.

In the nail supplying mechanism thus constructed, the connected nail assembly 104, which have been loaded and placed in a juxtaposed fashion, are supported in a state that those are pressed against the nail guide surface 106 by means of the second pressing members 116. The nail feeding member 121 is disposed such that it is advanced toward the nail guide surface 106 from the rear side of the nail guide surface 106. The connected nail assembly, which are located on the nail guide surface 106 by the nail feeding member 121, may be supplied to the nail introducing port 105. Therefore, there is no need of using the separator, which is indispensably used in the conventional technique. This accrues to the structure simplification and the weight reduction.

In the nail supplying mechanism, the second pressing members 116 (pressing means) is opened and closed with respect to the nail guide surface 106. Accordingly, the connected nail assembly 104 left on the nail guide surface 106 may be taken out by making the movable guide wall 109 open. In the invention, the nailing machine is held by one hand, and in this state, the connected nail assembly 104 may be taken out by the other hand. Accordingly, it is easy to replace a connected nail assembly with another connected nail assembly whose size is different from that of the former, and to replenish connected nail assemblies at a working place, e.g., nailing scaffold.

The magazine 103 may be constructed so as to receive three or more number of connected nail assemblies 104 in a juxtaposed fashion.

Figure 11:
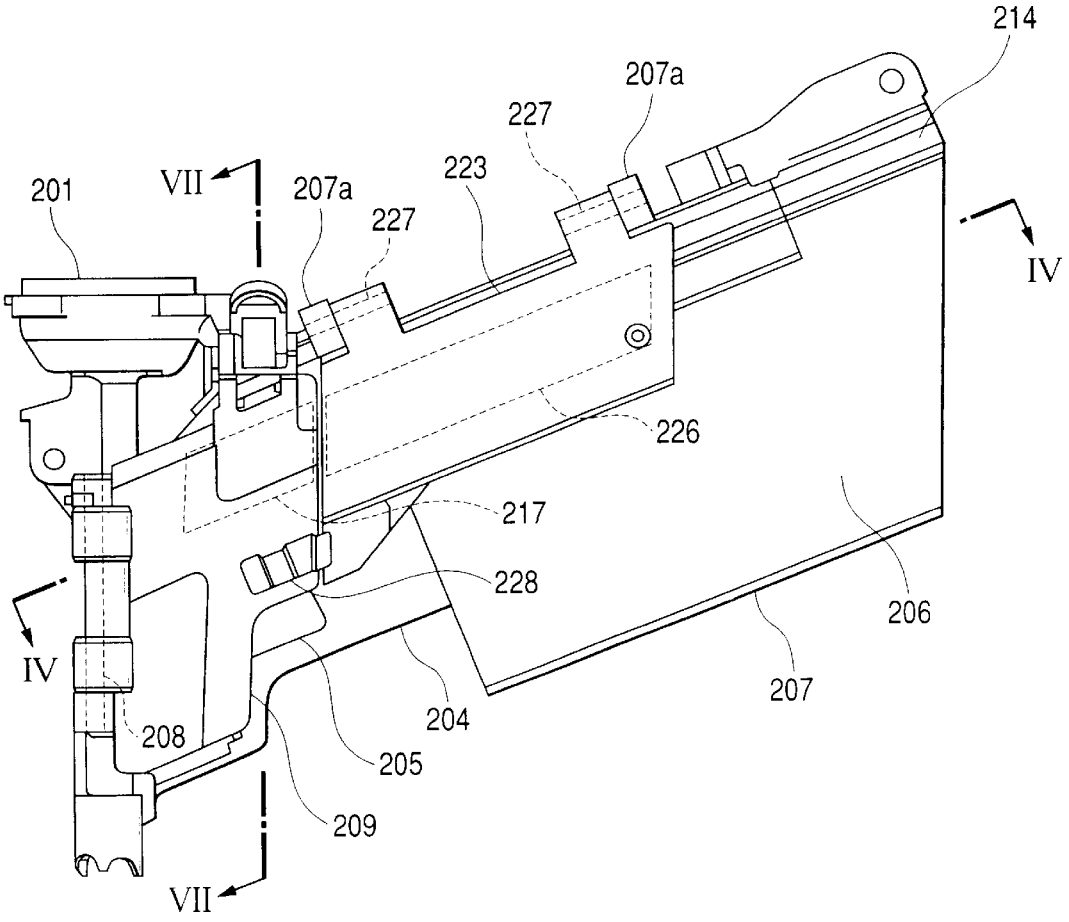
FIG. 11 is a side view showing an embodiment of a connected nail supplying mechanism according to the invention.
Figure 12:
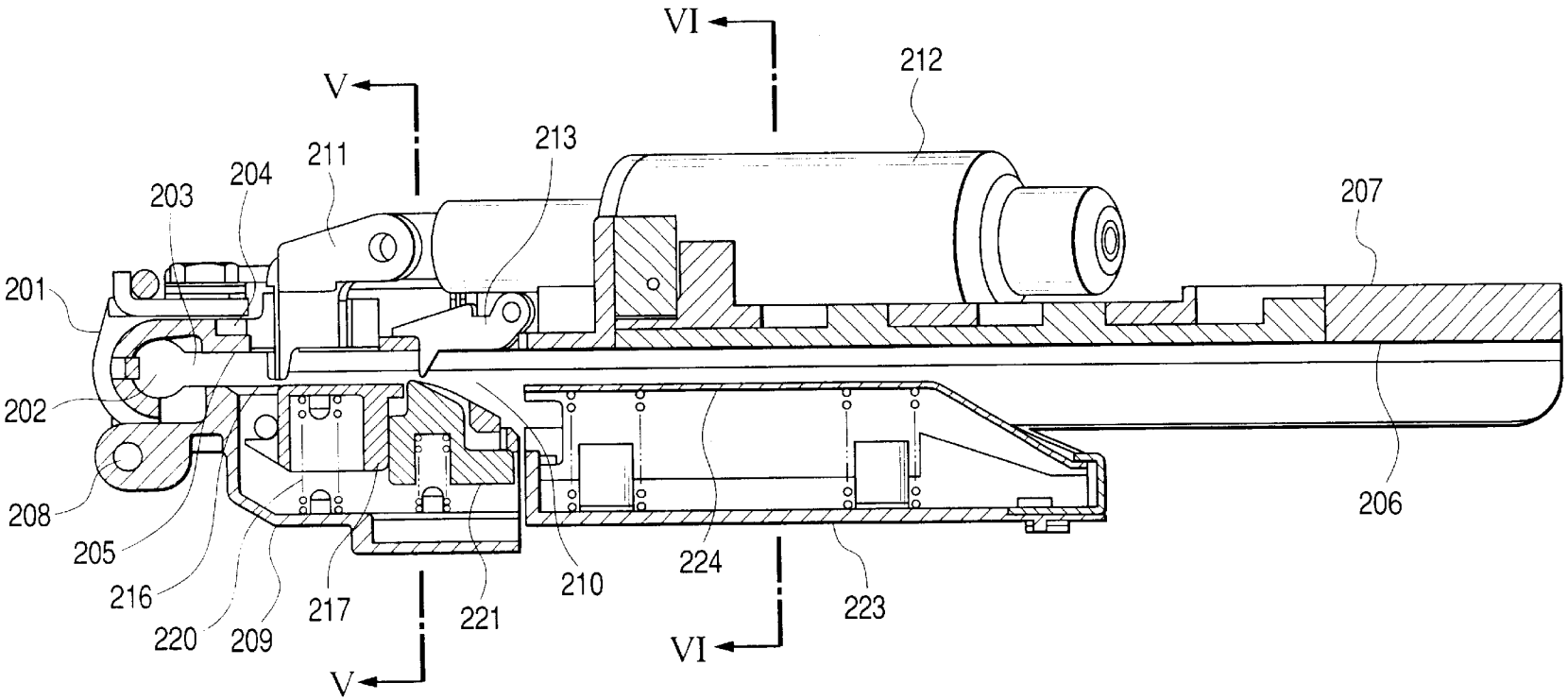
FIG. 12 is a transverse sectional view taken on line IV—IV in FIG. 11.
Figure 13:
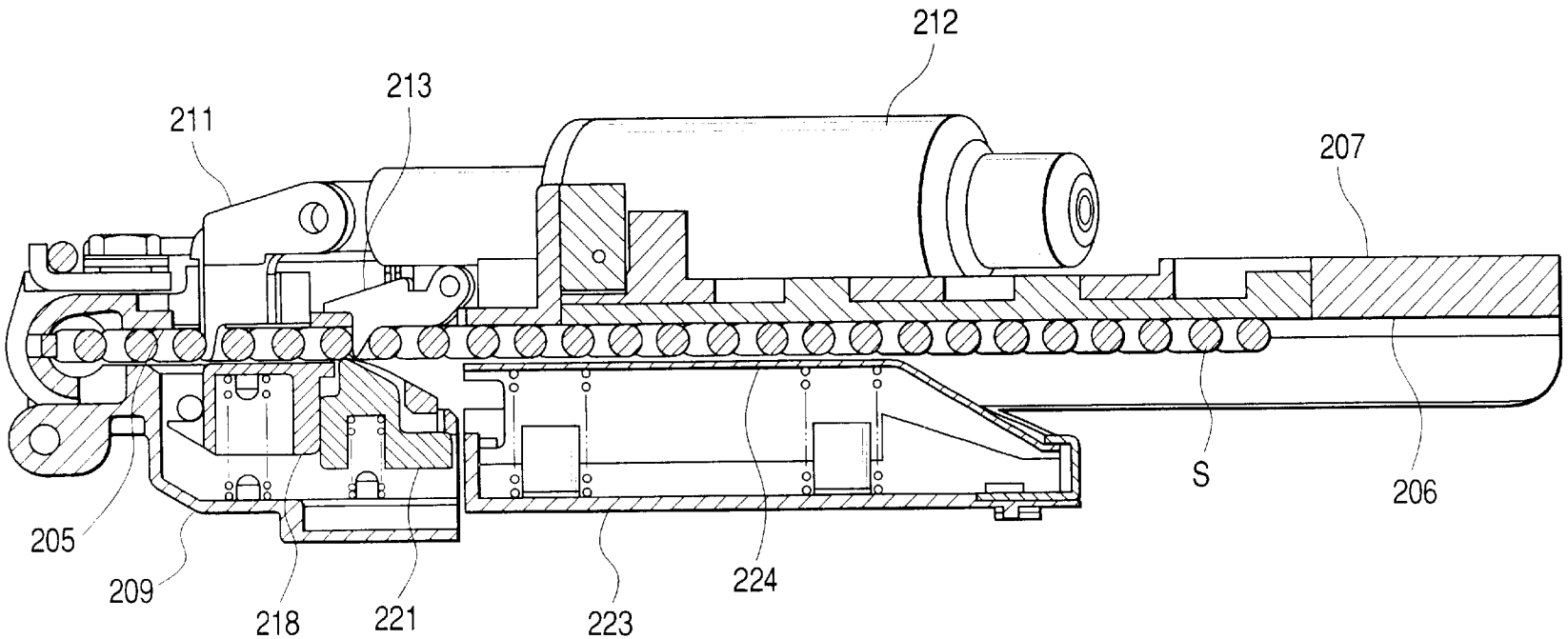
FIG. 13 is a transverse sectional view, similar to FIG. 12, showing a state that one sheet of a connected nail assembly are loaded into a magazine.

Next, other preferred embodiments of the present invention will be described with reference to the accompanying drawings of FIGS. 11 to 25. As shown in FIGS. 11 and 12, a nose portion 201 mounted on a lower part of a housing of a nailing machine includes a nail ejection opening 202 for slidably guiding a driver, which is driven by a driving cylindrical mechanism (not shown) The nose portion 201 includes an opening 203 for guiding nails into the nail ejection opening 202, and a fixed guide wall 204 which is continuous to the side edge of the opening 203. One side surface of the fixed guide wall 204 is used as a fixed guide surface 205 for supplying a connected nail assembly to the nail ejection opening 202. A magazine 207 is provided on the rear side of the fixed guide wall 204, which the magazine forms a connected nail support surface 206 being flush with the fixed guide surface 205 and extends rearward.

An opening/closing guide member 209 (door) is supported, in an opening/closing fashion, on the nose portion 201 by means of a pivotal shaft 208 arranged parallel to the nail ejection opening 202, while being confronted with the fixed guide surface 205 of the fixed guide wall 204. The opening/closing guide member 209 forms, when at its closed position, a part of the nail ejection opening 202 of the nose portion 201, and forms a nail supplying path 210 for the connected nail assembly between it and the fixed guide surface 205.

Disposed on the rear side of the fixed guide wall 204 of the nose portion 201 are a nail feeding member 211, a piston for reciprocatively driving the nail feeding member 211 along the nail supplying direction, and a nail feeding drive mechanism 212 based on a piston/cylinder mechanism containing the piston. A part of the nail feeding member 211 advances into a nail supplying path 210, through an opening formed in the fixed guide wall 204, and comes into engagement with those nail shanks of the connected nail assembly disposed along the fixed guide surface 205, and supplies the connected nail assembly toward the nail ejection opening 202 of the nose portion 201. A check pawl 213 is provided on the rear side of the fixed guide wall 204. The check pawl 213 checks the backward movement of the connected nail assembly when the nail feeding member 211 moves backward. A part of it advances through the opening into the nail supplying path 210 to come in engagement with the nail shafts of the connected nail assembly.

Figure 15:
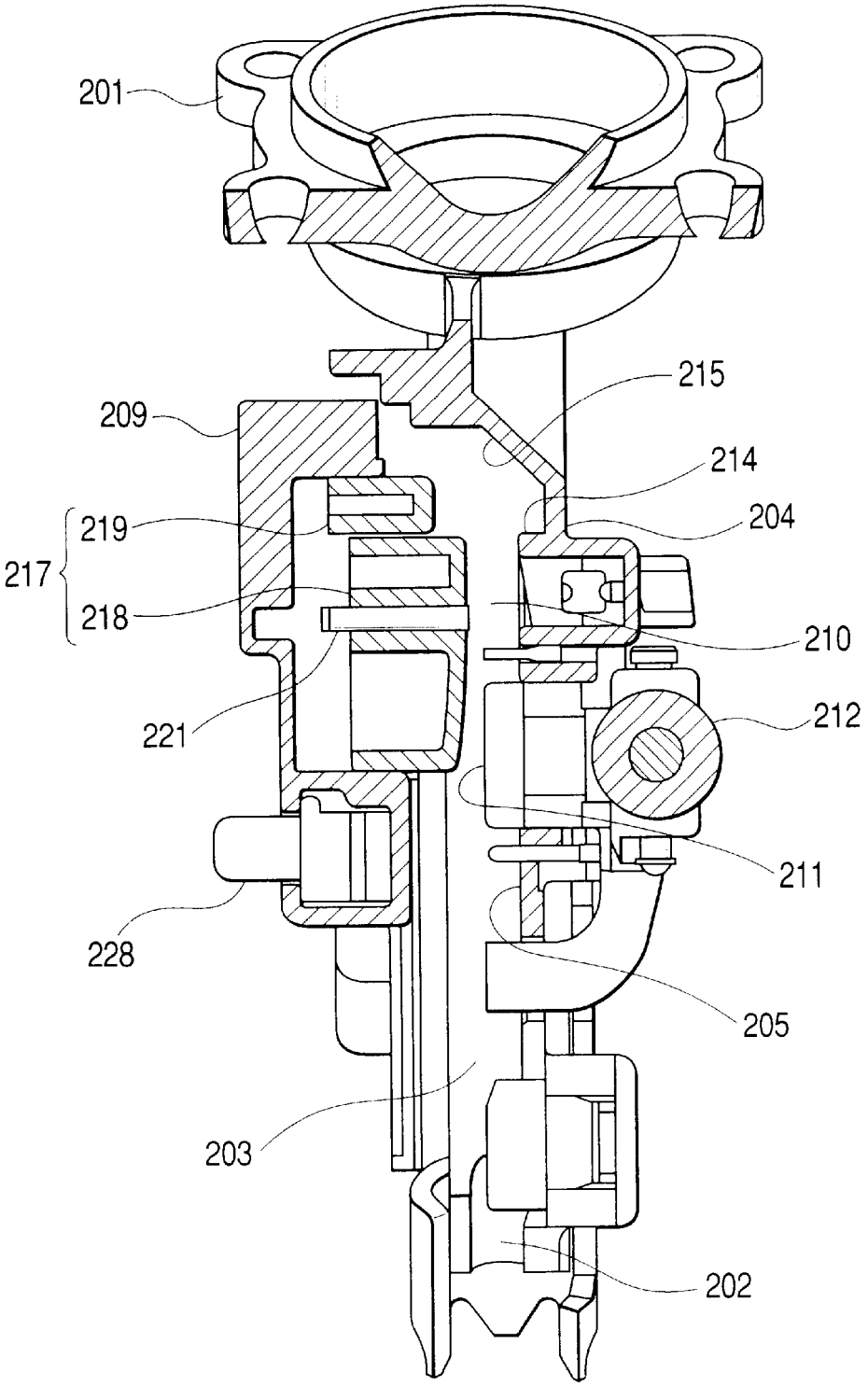
FIG. 15 is a sectional view taken on line V—V in FIG. 12.
Figure 16B:
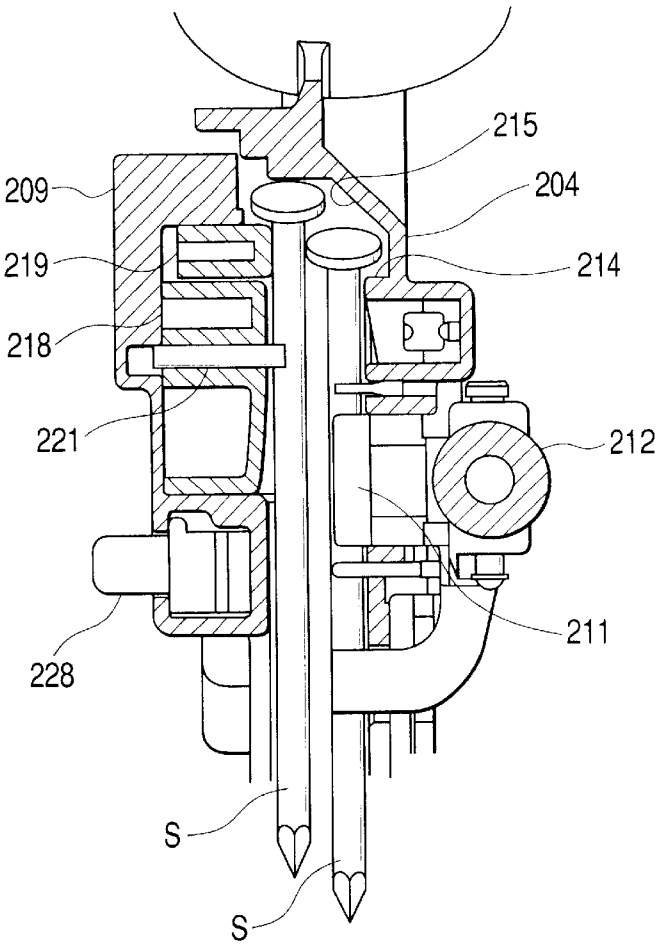
FIGS. 16(*a*) and 16(*b*) are sectional views, similar to FIG. 15, showing a state that connected nail assemblies are loaded into the magazine.
Figure 16A:
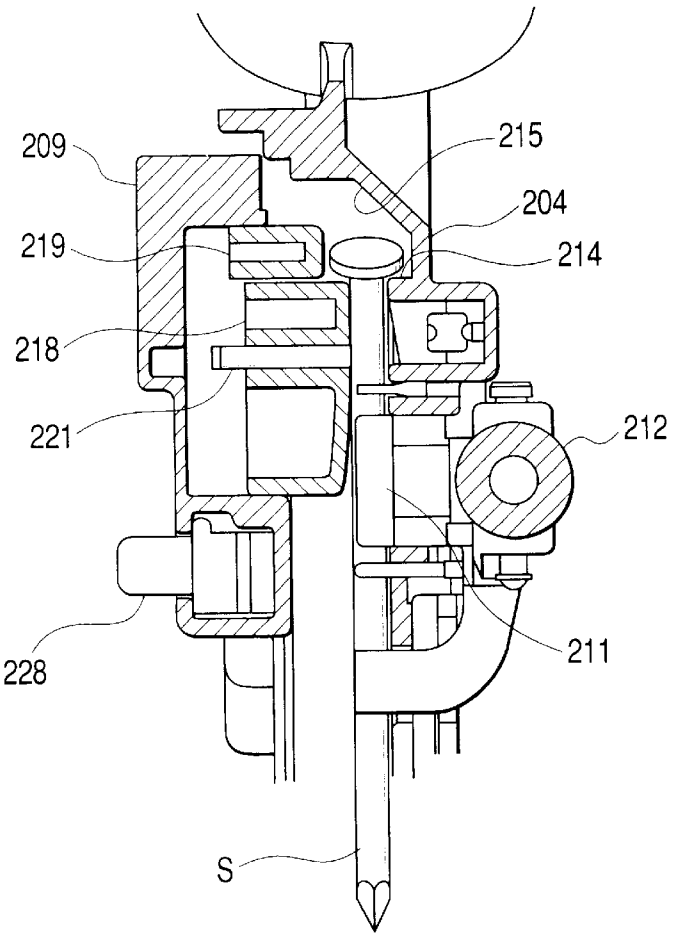

As shown in FIGS. 15, 16(*a*) and 16(*b*), shoulders 214 extending in the nail supplying direction are formed on the fixed guide surface 205 of the fixed guide wall 204 and the connected nail support surface 206 of the magazine 207. The shoulders 214 partly support the nail heads of the connected nail assembly disposed along those surfaces from their lower side. Further, a slanted guide surface 215 is provided above the shoulders 214, and are located above the nail heads of the first and second connected nail assemblies, which are disposed along the fixed guide surface 205 and the connected nail support surface 206. The connected nail assembly S is guided by the shoulders 214 and the slanted guide surface 215, with their vertical movement being restricted. The second connected nail assembly is aligned with the first connected nail assembly such that the nail heads of the second connected nail assembly are placed above the nail heads of the first connected nail assembly in an overlapping fashion when those connected nail assemblies are loaded into the magazine.

As shown FIGS. 12 and 15, the opening/closing guide member 209 includes an opening/closing guide surface 216 and a first pressing portion 217 for pressing the second connected nail assembly S against the fixed guide surface side. The opening/closing guide surface 216 is confronted with the fixed guide surface 205, while being spaced from each other by a fixed distance, at a position where the opening/closing guide member 209 is closed. The first pressing portion 217 includes a first pressing member 218 and a first head-supporting member 219. In a state that the second connected nail assembly S is loaded into the magazine, the first pressing member 218 presses the nail shank of the second connected nail assembly S toward the fixed guide surface 205. In a state that the second connected nail assembly S is not present, the first pressing member 218 advances under the nail heads of the first connected nail assembly S, and supports the downward movement of the connected nail assembly S. The first head-supporting member 219 advances under the nail heads of the second connected nail assembly S, and supports the downward movement of the second connected nail assembly S.

Figure 14:
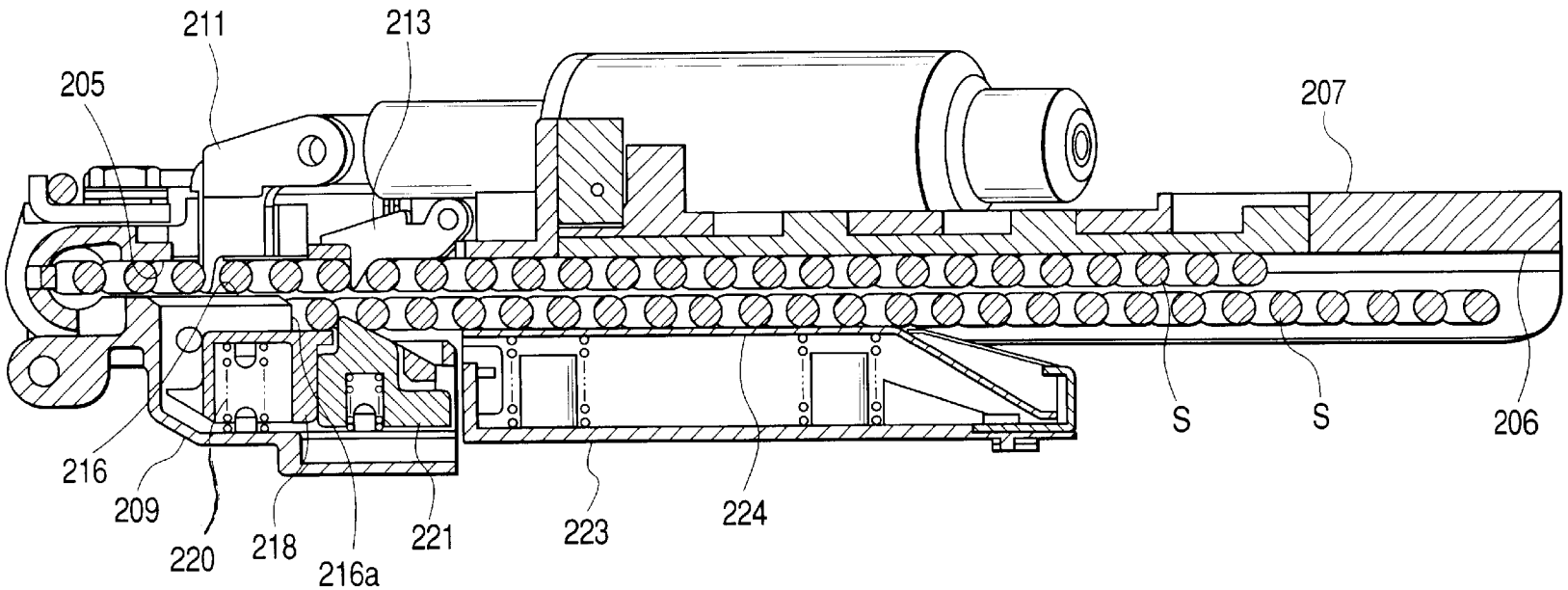
FIG. 14 is a transverse sectional view, similar to FIG. 12, showing a state that two sheets of connected nail assemblies are loaded into a magazine.

The first pressing member 218, as shown in FIGS. 12 and 14, is placed in a recess formed in the fixed guide surface 205 side of the opening/closing guide member 209, in a state that it is urged to the fixed guide surface 205 by means of a spring 220. In a state that the connected nail assembly is not loaded, the first pressing member is standstill at a position where the nail supplying path 210 is formed, while being spaced away from the fixed guide surface 205 by a predetermined distance. The upper surface of the first pressing member 218, as shown in FIG. 15, is level with the shoulders 214 of the fixed guide surface 205 so that the first connected nail assembly S loaded along the fixed guide surface 5 cooperates with the shoulders 214 of the fixed guide surface 205 to support the lower side of the nail heads of the connected nail assembly. The first head-supporting member 219, like the first pressing member 218, is also placed in a recess of the opening/closing guide member 209, and urged toward the fixed guide surface 205 by means of a spring. A stroke of the first head-supporting member 219 is selected so as not to contact the nail heads of the first connected nail assembly S. In a state that the second connected nail assembly S is loaded into the magazine as shown in FIG. 16 (*b*), the first pressing member 218 and the first head-supporting member 219 are both brought into contact with the nail shanks of the second connected nail assembly to press both the connected nail assemblies against the fixed guide surface 205. Further, the upper surface of the first head-supporting member 19 advances under the nail heads of the second connected nail assembly and supports the second connected nail assembly.

When the nailing work progresses and the first connected nail assembly is used up, then the second connected nail assembly is laterally moved since it is thrust toward the position where the first connected nail assembly is pressed by the first pressing member 218 and the first head-supporting member 219. At this time, the first head-supporting member 219 stands at a mid position of the stroke, and disengages from the lower side of the nail heads of the connected nail assembly S being further moved laterally by the first pressing member 218. In this state, the second connected nail assembly is allows to move downward. The nail heads of connected nail assembly S come in contact with the slanted guide surface 215, and the connected nail assembly is guided downward and to a position for the first connected nail assembly. In this state, within the nail supplying path 210 formed between the fixed guide surface 205 and the first pressing member 218, the connected nail assembly S is held in a state that the lower sides of the nail heads thereof are supported on the upper surfaces of the shoulders 214 and the first pressing member 218.

Figure 21:
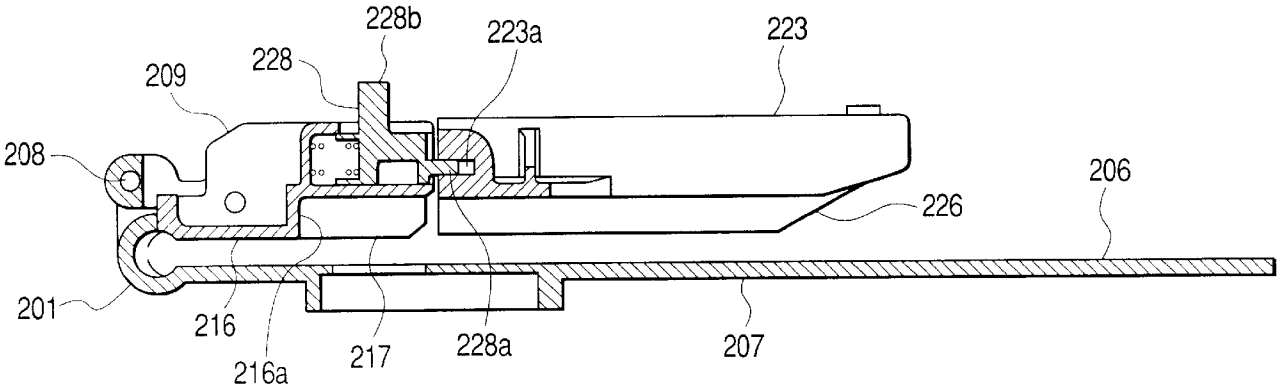
FIG. 21 is a cross sectional view showing a state that the magazine cover is closed with respective to an opening/closing guide member.
Figure 22:
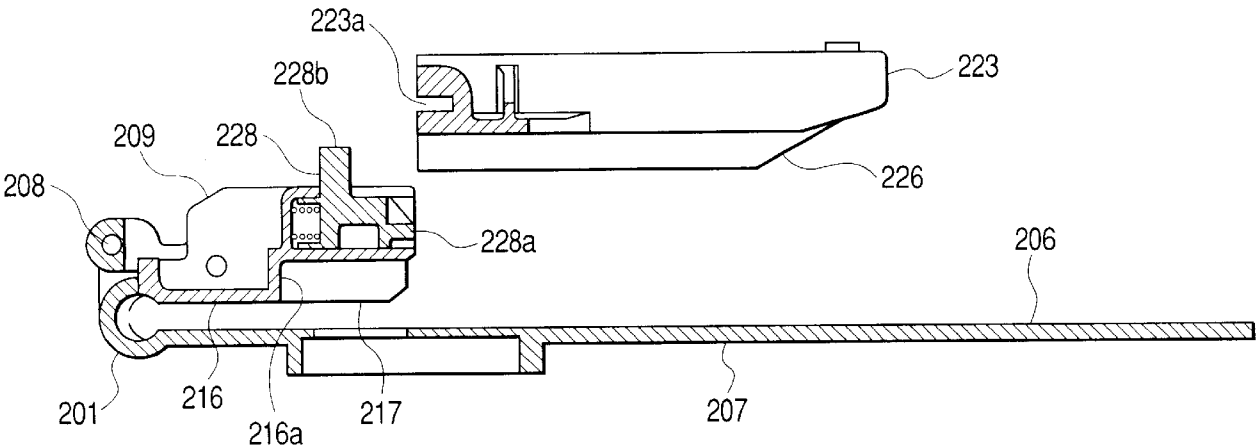
FIG. 22 is a cross sectional view showing a state that the magazine cover is opened with respective to an opening/closing guide member.

The opening/closing guide member 209 includes a seizing pawl member 221 engaging the nail shanks of the connected nail assembly located at the position of the second connected nail assembly for preventing the second connected nail assembly from moving backward. A part of the seizing pawl member 221 passes through a window formed in the first pressing member 218 and is protruded toward the fixed guide surface 205. The seizing pawl member 221 is slidable in a direction vertical to the nail supplying direction, and urged by a spring 222 such that the tip of the pawl is projected to the nail supplying path direction. A slanted surface 221*a* is formed in the rear part of the pawl. At the time of loading the connected nail assembly S to be located at a position for the second connected nail assembly, the slanted surface 221*a* engages the nail shank of the foremost or first nail of the connected nail assembly, and retracts from the nail supplying path 210, thereby permitting the loading of the connected nail assembly. The front face of the pawl tip serves as a substantially vertical engaging face 221*b*, and engages the nail shank of the connected nail assembly loaded, to thereby block the backward movement of the connected nail assembly S. It is necessary to locate the seizing pawl member 221 at the position of the rear end of the operating stroke of the nail feeding member 211 or a position located ahead of the rear end position so that when the second connected nail assembly engaged and stopped by the seizing pawl member 221 is moved to the first connected nail assembly position, it is fed with the nail feeding member 211. A protruding stroke of the seizing pawl member 221 is restricted so that it does not engage the first connected nail assembly. As shown in FIGS. 14, 21 and 22, a stopping face 216*a* constituted by the end face of the opening/closing guide surface 216 is located at a position ahead of the seizing pawl member 221. The stopping face 216 engages the nail shank of the foremost nail of the second connected nail assembly at the position ahead of the seizing pawl member 221 to stop the thrusting of the connected nail assembly.

Figure 23:
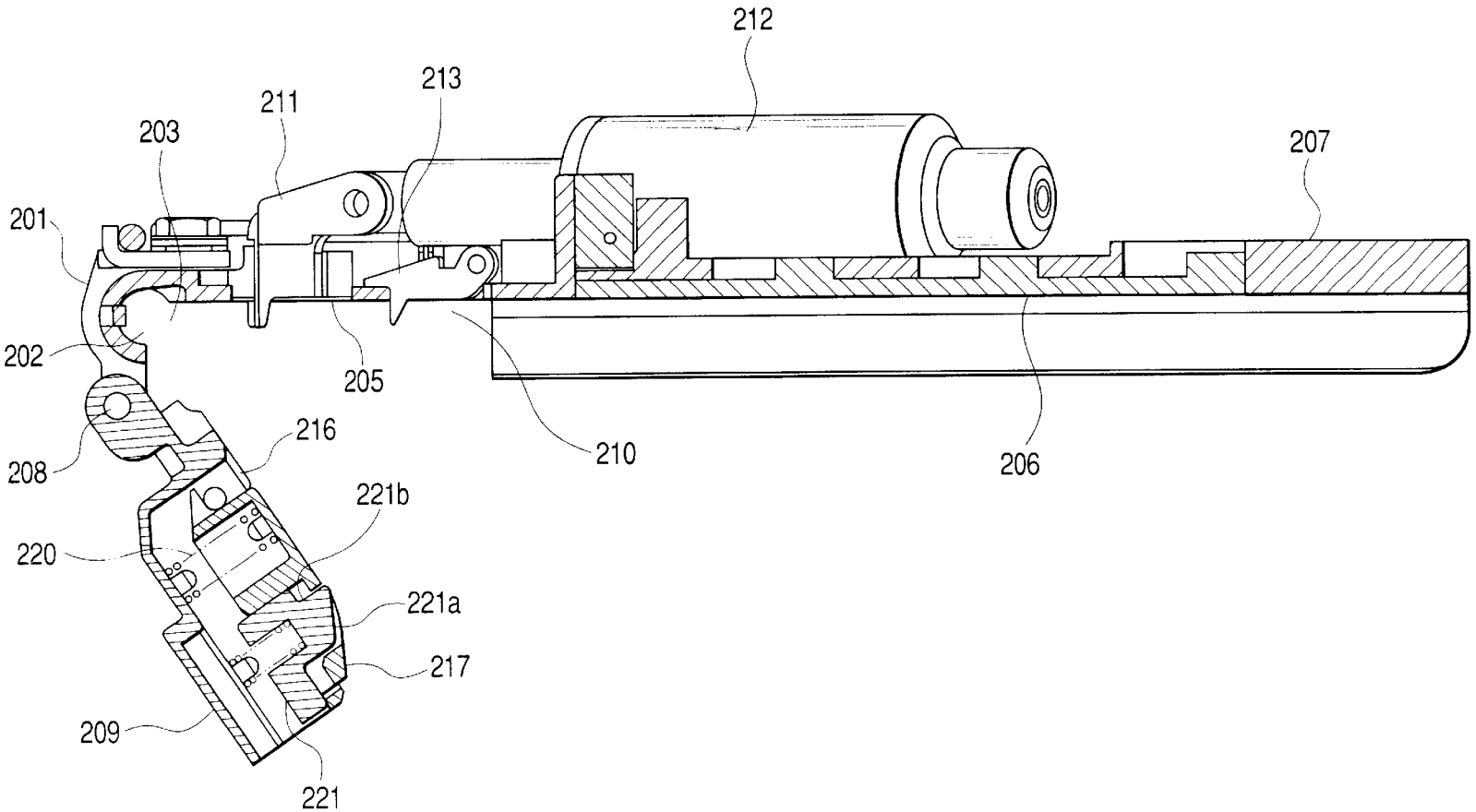
FIG. 23 is a transverse sectional view showing a state that the opening/closing guide member is opened.
Figure 24:
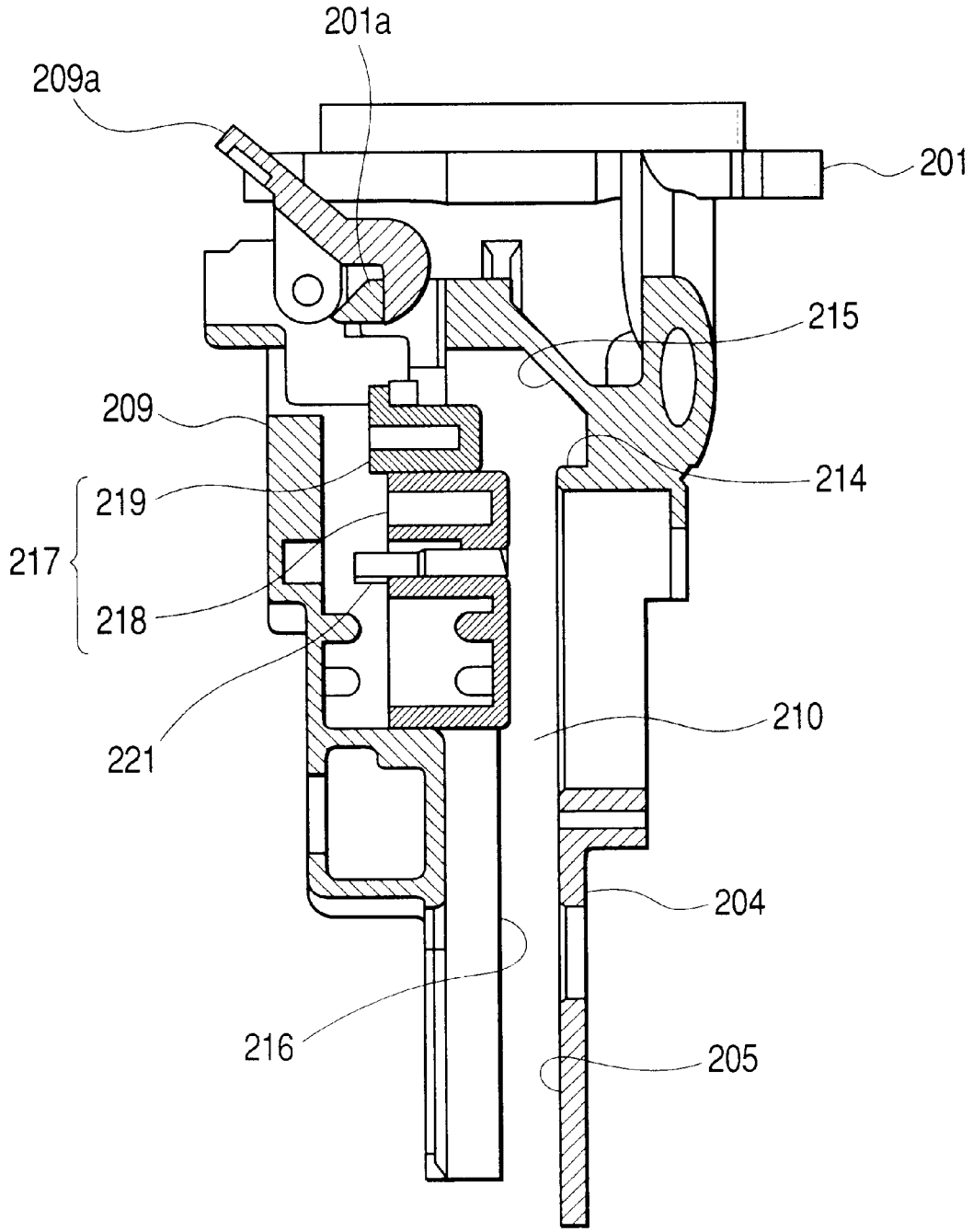
FIG. 24 is a cross sectional view, taken on line V—V in FIG. 11, showing a state that the opening/closing guide member is fixed.

At a position close to the nail ejection opening 202 of the nose portion 201, the opening/closing guide member 209 is pivotally supported on a pivotal shaft 208 that is directed substantially parallel to the axial line of the ejection opening. As shown in FIG. 23, the opening/closing guide member may be turned to an open position at which the fixed guide surface 205 of the fixed guide wall 204 is open. At a closed position located opposite to and spaced from the fixed guide surface 205 by a predetermined distance, a latch mechanism 209*a* engages an engaging part 201*a* of the nose portion 201 (FIG. 24), and it is locked at the closed position.

A magazine cover 223 is provided at a rear part of the opening/closing guide member 209 as viewed in the supplying direction. The magazine cover 223 pressingly supports the side of the first and second connected nail assemblies, which are loaded along the connected nail support surface 206 of the magazine 207, on the rear side of the opening/closing guide member 209. The magazine cover 223 is provided with a second pressing portion 226, which is composed of a second pressing member 224 and a second head-supporting member 225, which resemble the first pressing member 218 and the first head-supporting member 219, respectively. The second pressing member 224 urged toward the connected nail support surface 206 presses the first and second connected nail assemblies against the connected nail support surface 206, and the second head-supporting member 225 advances to the lower side of the nail heads of the second connected nail assembly to support the connected nail assembly. Thus, the pressing member supports the side of the connected nail assemblies S loaded along the connected nail support surface 206, and the head-supporting member supports the lower side of the nail heads of the second connected nail assembly. Accordingly, both members are each divided into first and second members as viewed in the nail supplying direction.

Figure 17:
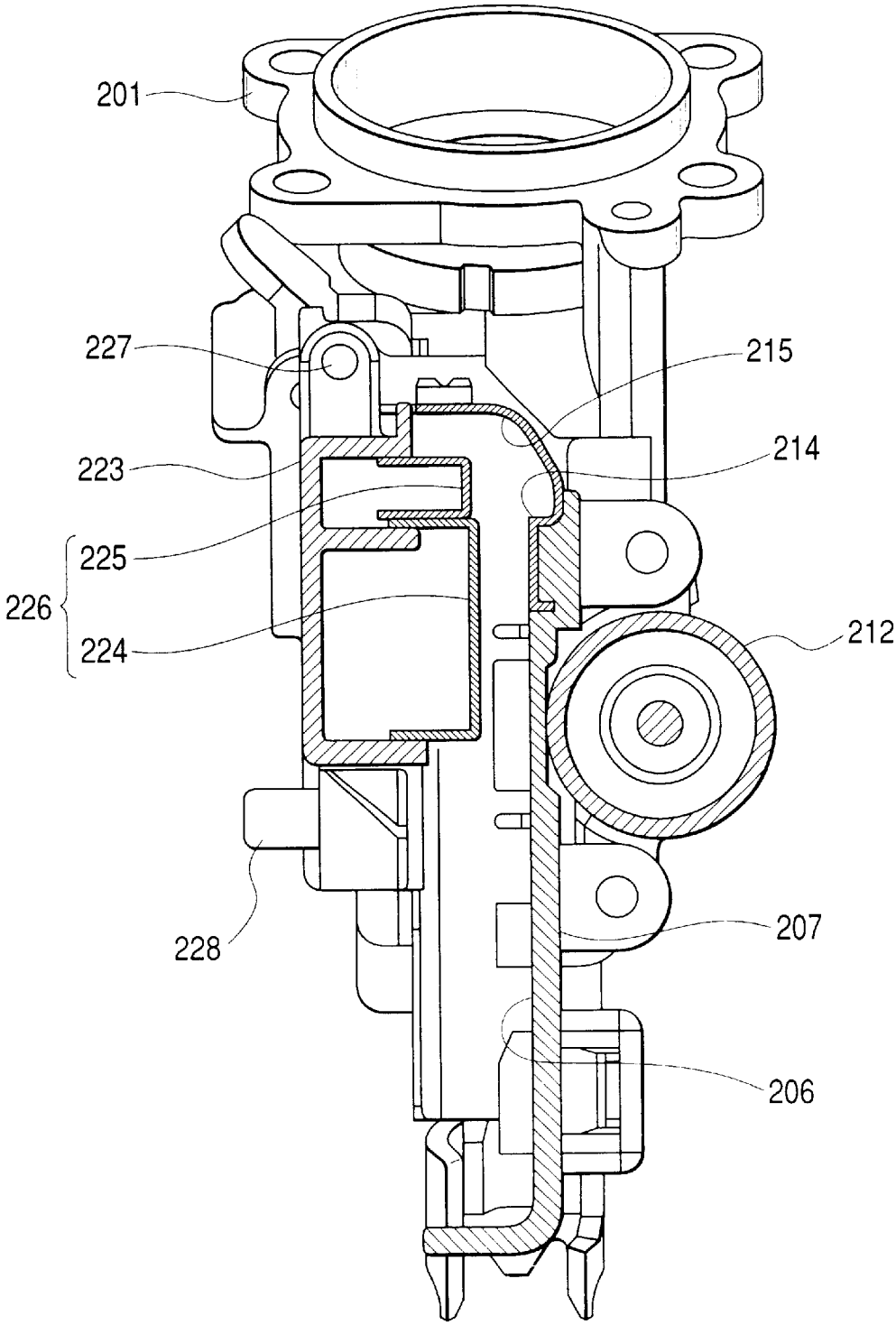
FIG. 17 is a sectional view taken on line VI—VI in FIG. 12.
Figure 18B:
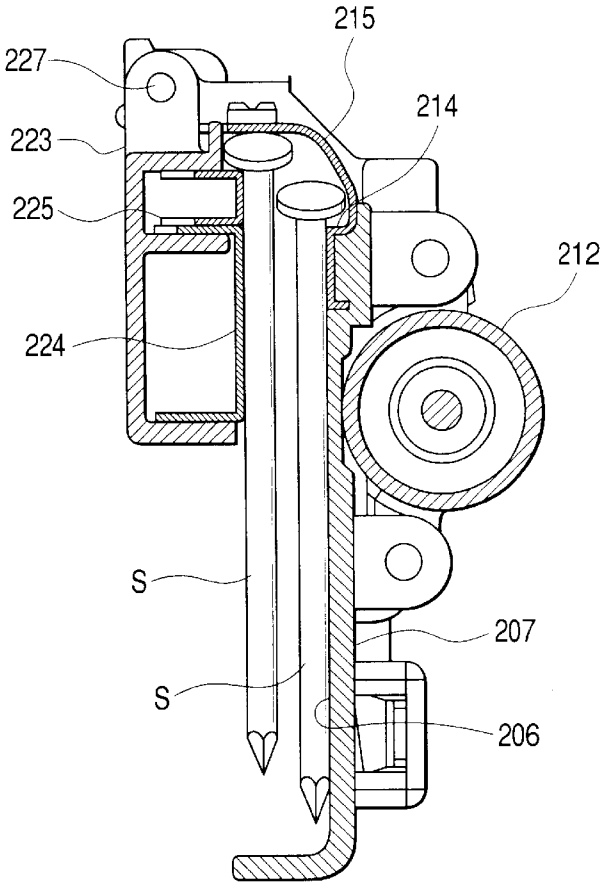
FIG. 18 is a sectional view, similar to FIG. 17, showing a state that connected nail assemblies are loaded into the magazine.
Figure 18A:
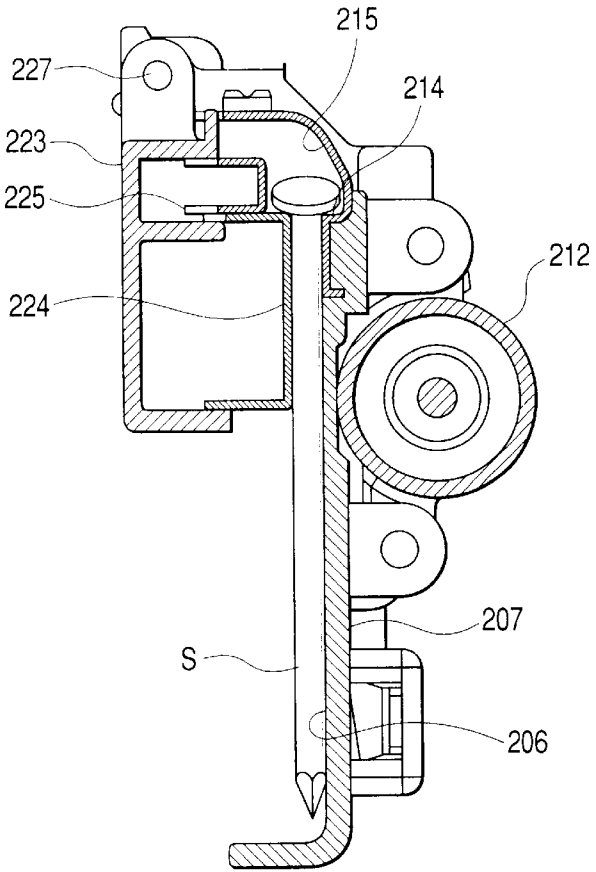
Figure 19:
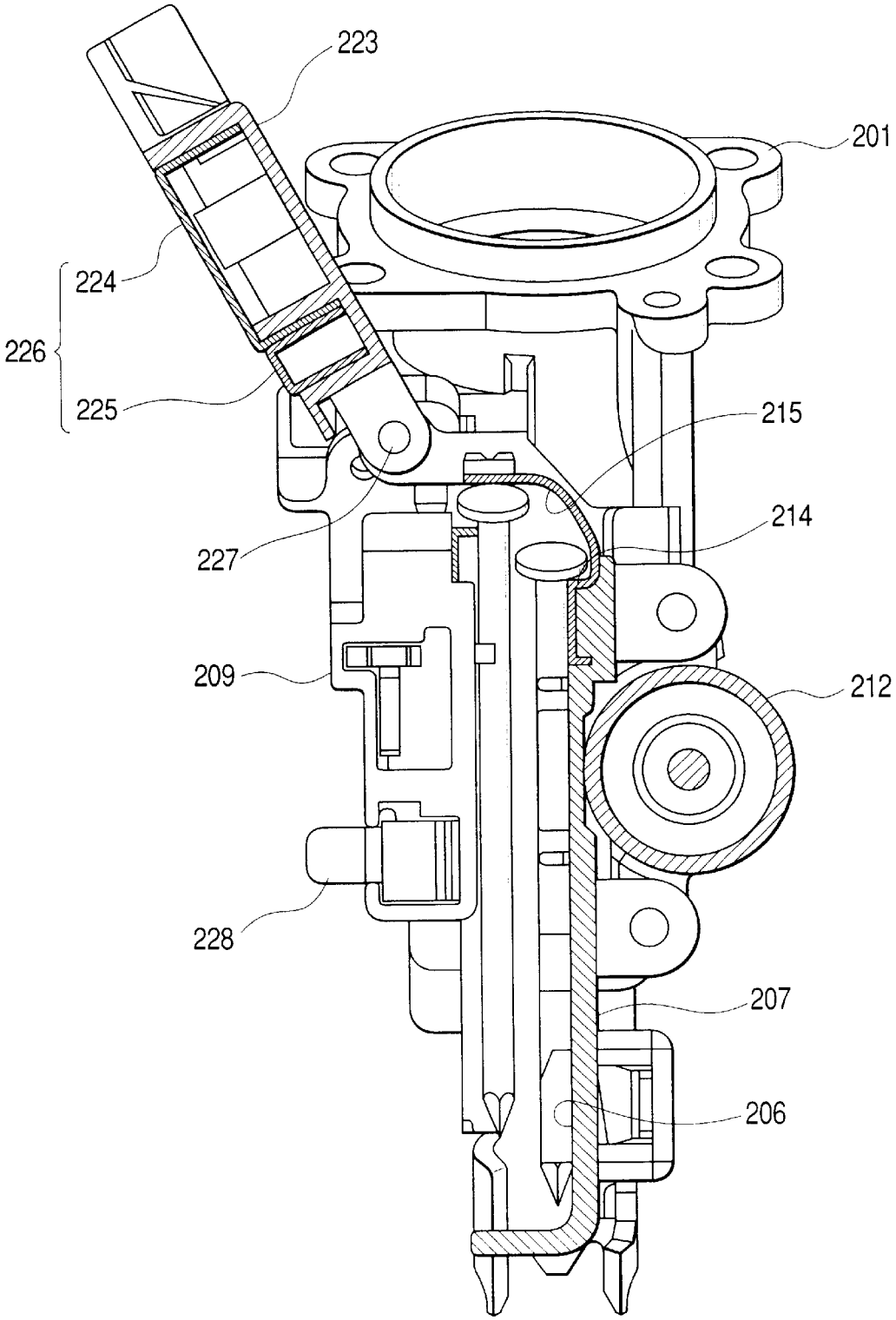
FIG. 19 is a sectional view, taken on line VII—VII in FIG. 11, showing a state that a magazine cover is opened.
Figure 20:
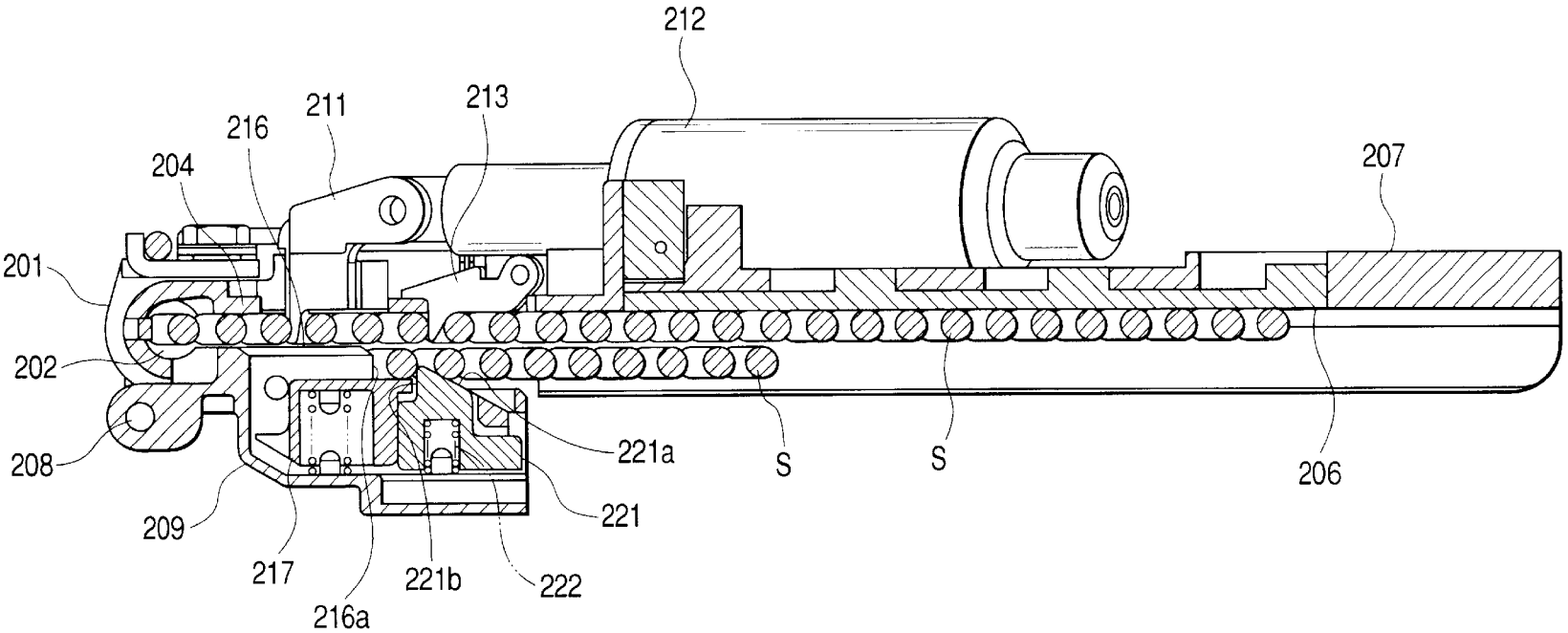
FIG. 20 is a transverse sectional view showing a state that the connected nail assemblies is loaded when the magazine cover is opened.

As shown in FIGS. 17, 18 (*a*) and 18(*b*), the magazine cover 223 is pivotally supported on a pivotal shaft 227, which is disposed parallel to the connected nail assembly supplying direction by a bearing 207*a* formed on the upper surface of the magazine 207. The second pressing member 224 and the second head-supporting member 225 are turned between a closed position parallel to the connected nail support surface 206 and an open position at which those stand apart from the side surface of the connected nail support surface 206 and the connected nail assembly loading part of the fixed guide surface 205 is open, as shown in FIGS. 19 and 20. When the opening/closing guide member 209 is located at the closed position, an engaging protrusion 228*a* of a latch mechanism 228 provided on the opening/closing guide member 209 advances into an engaging hole 223*a* formed in the end face of the magazine cover 223, and the magazine cover 223 is placed at the closed position. The magazine cover 223 is constantly urged toward the open position, so that it automatically turns to the open position by operating an operation lever 228*b* of the latch mechanism 228.

Figure 25:
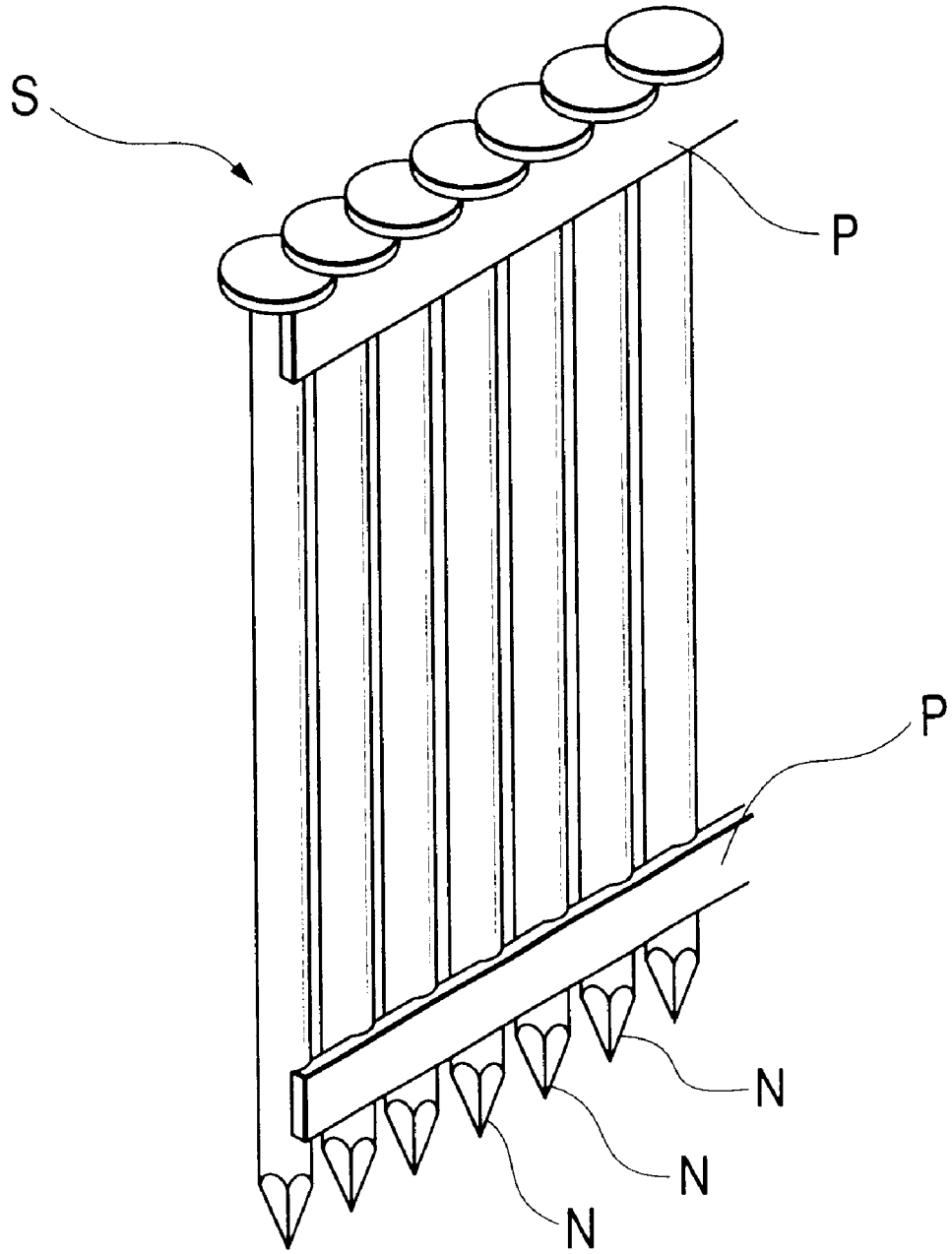
FIG. 25 is a perspective view showing a connected nail assembly used in a nail supplying mechanism constructed according to the invention.

An example of forming the connected nail assembly S used in the embodiment is shown in FIG. 25. In a case that a paper tape is used, one of the major surfaces of the paper tape is coated with adhesive made of thermoplastic, e.g., hot melt. A series of nails are arranged side by side with their shanks being parallel to one another, and heated. The adhesive surface of the paper tape is pressed against the shanks of those heated nails, and then the resultant is cooled. As a result, a connected nail assembly S containing a series of nails interconnected is formed. Specifically, two connecting strips P are located at two positions; one position on the nail shanks close to the nail heads and the other close to the nail tips. As a result, the side edges of the nail heads of the connected nail assembly S are brought into contact with the connecting strip P of the connected nail assembly S where the nail shanks are arranged in side-by-side relation. A surface of the connecting strip P is flat and extends in the connecting direction. Accordingly, the side edges of the heads or shanks of the side-by-side arranged nails of the connected nail assemblies are not put in between the adjacent shanks, and hence smoothly slidable.

How to load the connected nail assembly into the nail supplying mechanism described above will be described. A first connected nail assembly S is loaded into the magazine being empty after the opening/closing guide member 209 and the magazine cover 223 are both put at the closed position. The connected nail assembly S is loaded along the connected nail support surface 206 of the magazine 207, whose side is open, and the fixed guide wall 204 of the fixed guide surface 205 from its side such that the nail heads of the connected nail assembly are supported by the shoulders 214 of the connected nail support surface 206 and the fixed guide surface 205, and the first nail of the connected nail assembly is located within the nail ejection opening 202 of the nose portion 201. In this state, the opening/closing guide member 209 and the magazine cover 223 are moved to the closed position, and locked by the latch mechanism 228. As a result, the nail heads of the first connected nail assembly S are supported on the shoulders 214 of the connected nail support surface 206 and the upper face of the first head-supporting member 219, and the nail feeding member 211 and the check pawl 213 advance between the nail shanks of the connected nail assembly S. Here, the loading of the connected nail assembly ends.

A second connected nail assembly S is loaded along the first connected nail assembly S already loaded. The pressing portions 217 and 226 are moved backward by the inserted connected nail assembly while resisting the urging force by the spring. The first and second head-supporting members 219 and 225 advance under the nail heads of the second connected nail assembly, and support the second connected nail assembly in a state that the nail heads of the former are separated from those of the first connected nail assembly. The first nail of the second connected nail assembly pushes aside and is positioned ahead the seizing pawl member 221. In this state, the first nail of the connected nail assembly comes in contact with the stopping face 216*a* of the opening/closing guide surface 216 of the opening/closing guide member 209, and stopped. The seizing pawl member 221 advances to the rear side of the nail shank of the first nail of the connected nail assembly, thereby blocking the backward movement of the second connected nail assembly. Here, the loading operation ends. The pressing portions 217 and 226 press, by the spring urging force, the first and second connected nail assemblies against the fixed guide surface 205 and the connected nail support surface 206 through the second connected nail assembly. The nail heads of the first connected nail assembly are supported on the fixed guide surface 205 and the shoulders 214 of the connected nail support surface 206. The nail heads of the second connected nail assembly are supported by the first and second head-supporting members 219 and 225.

When a connected nail assembly being shorter than the normal nail as is taken out of the magazine in a case that the connected nail assembly is broken or during the nailing operation, the user's hand that presses the rear end of the connected nail assembly comes in contact with the end face of the magazine cover 223 so that such a connected nail assembly is loaded to the position of the second connected nail assembly. As a result, he or she will sometimes fail to press and move the connected nail assembly to the positions of the check pawl 213 and the seizing pawl member 221. It is suggestible that such a short connected nail assembly is loaded into the magazine in a state that the magazine cover 223 is turned to the open position as shown in FIGS. 19 and 20. By so doing, the short connected nail assembly is reliably moved to the seizing pawl member 221 of the opening/closing guide member 209. Thereafter, the magazine cover 223 is locked at the closed position, and the loading operation ends.

The feeding of the connected nail assemblies loaded into the magazine will be described. The nailing machine, which is loaded with the first and second connected nail assemblies, is operated for nailing. Then, immediately after the nail located within the nail ejection opening 202 of the nose portion 201 is driven out by a driver (not shown), the nail-feeding drive mechanism 212 operates to move the nail feeding member 211 backward. The nail feeding member 211 comes in contact with the nail shank of the first connected nail assembly and is retracted from the nail supplying path 210. During the retracting motion, it advances again into the nail supplying path 210, at the rear end position of the reciprocating stroke, and engages the nail shank. During this period, the check pawl 213 engages the nail shank of the first connected nail assembly to block its backward movement. In synchronism with the retracting operation of the driver, which has driven out the nail, from the nail ejection opening 202, the nail feeding member 211 is driven and moved forward, and moves the first connected nail assembly toward the nose portion 201. The first nail is fed into the nail ejection opening 202 and comes in contact with the inner wall of the nail ejection opening 202. The nail feeding member 211 is stopped in its movement, and the nail feeding operation ends. The nailing machine is ready for the next nailing operation.

The nails of the first connected nail assembly are successively driven out, and the final nail is moved ahead the foremost nail of the second connected nail assembly. At this time, the second connected nail assembly is moved toward the fixed guide surface 205 by the spring urging force of the first and second pressing members 218 and 224. The first and second head-supporting members 219 and 225 stop during the operation stroke, so that the support of the lower side of the nail heads is removed. The nail heads come in contact with the slanted guide surface 215. As a result, the connected nail assembly is moved downward, and those reach a position behind the first connected nail assembly. At this position, the check pawl 213 engages the back of the first nail to block its backward movement. In the next nail driving operation, the nail feeding member 211 engages the nail shank of the second connected nail assembly, and the nails of the second connected nail assembly are successively fed to the nail ejection opening 202, following the feeding of the first connected nail assembly.

As seen from the foregoing description, a magazine of the invention includes a magazine forming a connected nail support surface which is flush with a fixed guide surface continuous to a nail ejection opening and linearly extends, and pressing portion for pressing a connected nail assembly disposed along the connected nail support surface of the magazine against the connected nail support surface confronted with the fixed guide surface and the connected nail support surface. Thus, the magazine of the invention, unlike the conventional one, is not of the box type. Accordingly, the magazine width may be reduced, and hence the invention succeeds in providing a nailing machine which is low in weight and small in size. It is noted that a supporting portion for supporting the nail heads of the second connected nail assembly on the lower side thereof is provided. With this feature, the first and second connected nail assemblies are disposed such that the nail heads of those connected nail assemblies are spaced from each other. Therefore, there is no chance that the nail heads of the adjacent connected nail assemblies interfere with each other. Further, the first connected nail assembly may be fed to the nail driving portion smoothly.

Additionally, the rear end of the pressing portion is positioned ahead the rear end of the magazine. With this feature, when the connected nail assembly is loaded into the magazine, from the rear end of the magazine, the connected nail assembly may easily be moved, by pressing, to the loading position. A seizing pawl member for seizing the second connected nail assembly is provided in connection with a stroke of a nail feeding member, and a stopping face is formed at the front part of the seizing pawl member. With this feature, the second connected nail assembly may be loaded and reliably put at a position where the second connected nail assembly is fed to the nail ejection opening, following the feeding of the first connected nail assembly.

A pressing portion is provided on an opening/closing guide member 209 which may be opened and closed with respective to the nose portion, and may be opened for the fixed guide surface and the connected nail support surface. Therefore, one side of a nail supplying path defined by the fixed guide surface of the fixed guide wall may be opened, and the first nail of the connected nail assembly may directly be loaded into the nail ejection opening. As a result, there is no need for the idling operation for the feeding the loaded nails to the nail ejection opening. Also when the connected nail assembly currently used is replaced with another connected nail assembly whose nail size is different from that of the former, the connected nail assembly left in the magazine may easily be removed.

Further, the pressing portion are provided on the opening/closing guide member which may be opened and closed with respective to the nose portion, and a magazine cover which may be opened and closed with respective to the magazine, and only the magazine cover may be opened to an open position independently. A connected nail assembly being shorter than the normal nail, as is taken out of the magazine when the connected nail assembly is broken or during the nailing operation, is easily loaded to the position of the second connected nail assembly.

Furthermore, the pressing portion is divided into a pressing member and a head-supporting member for supporting the nail heads of the second connected nail assembly, a stroke of the head-supporting member is restrictively selected, and a slanted guide surface is provided above the nail heads of the first and second connected nail assemblies loaded at the positions of the first and second connected nail assemblies. Therefore, the second connected nail assembly may be guided to the position of the first connected nail assembly, and further an upward movement of the first connected nail assembly may be suppressed by the slanted guide surface.

Next, the other preferred embodiments of the present invention will be described with reference to the accompanying drawings of FIGS. 26 to 31.

Figure 26:
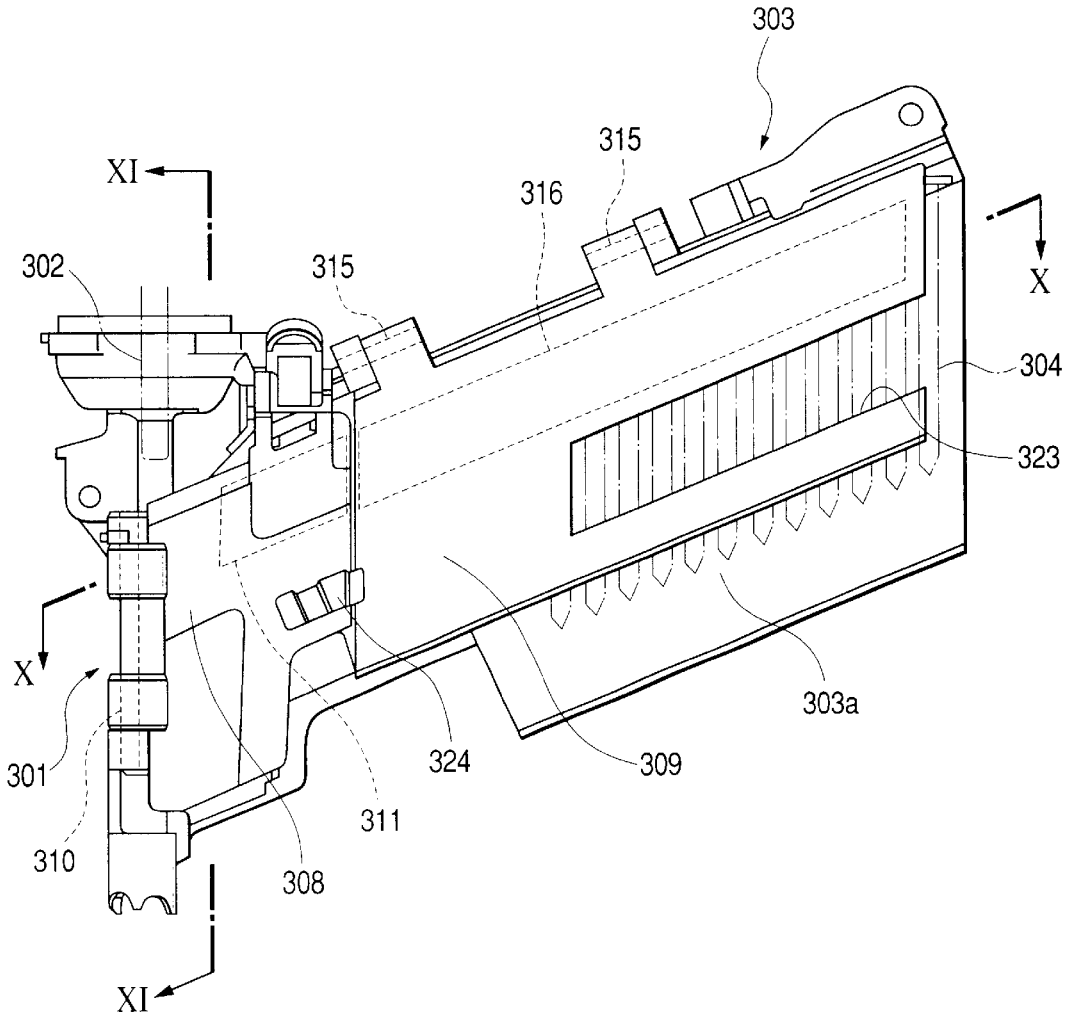
FIG. 26 is a side view showing a lower part of a nailing machine constructed according to the present invention.
Figure 27:
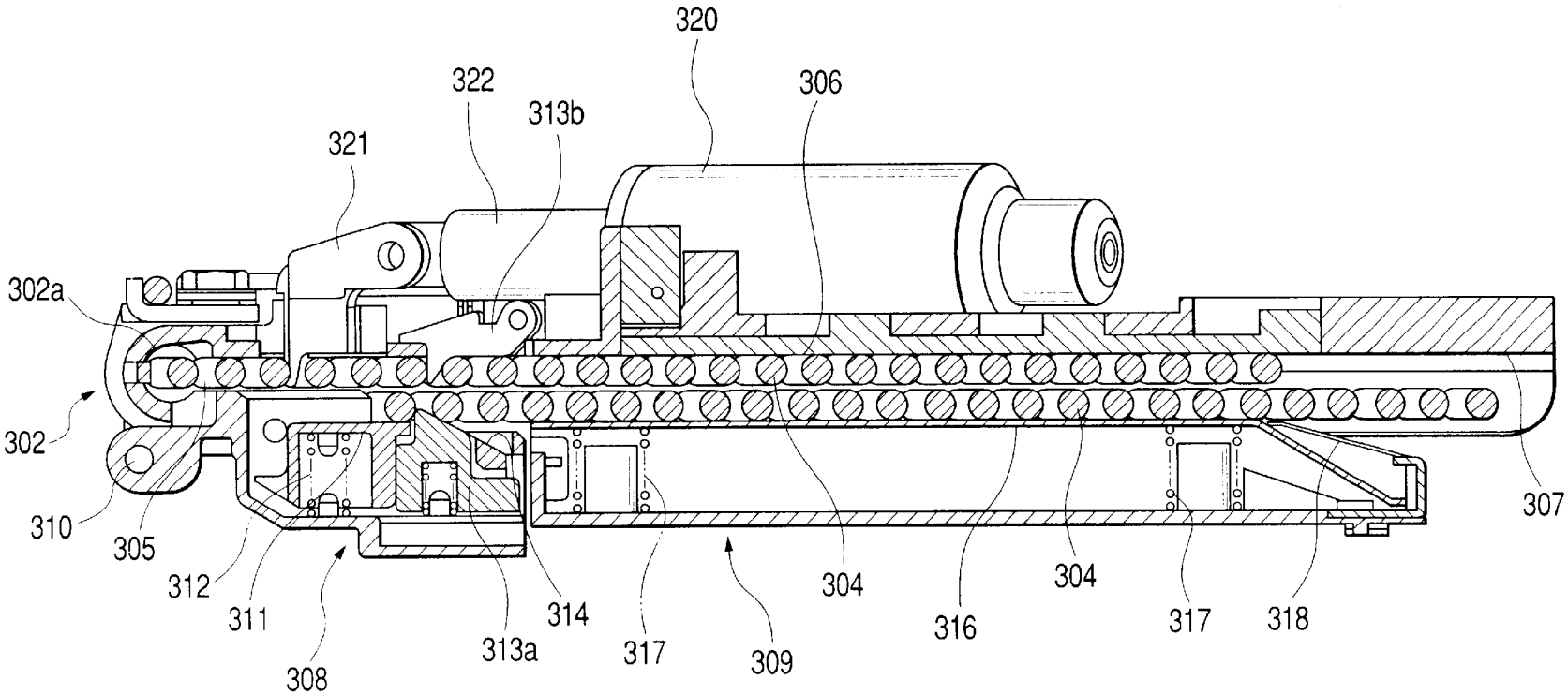
FIG. 27 is a cross sectional view taken on line X—X in FIG. 26.
Figure 28:
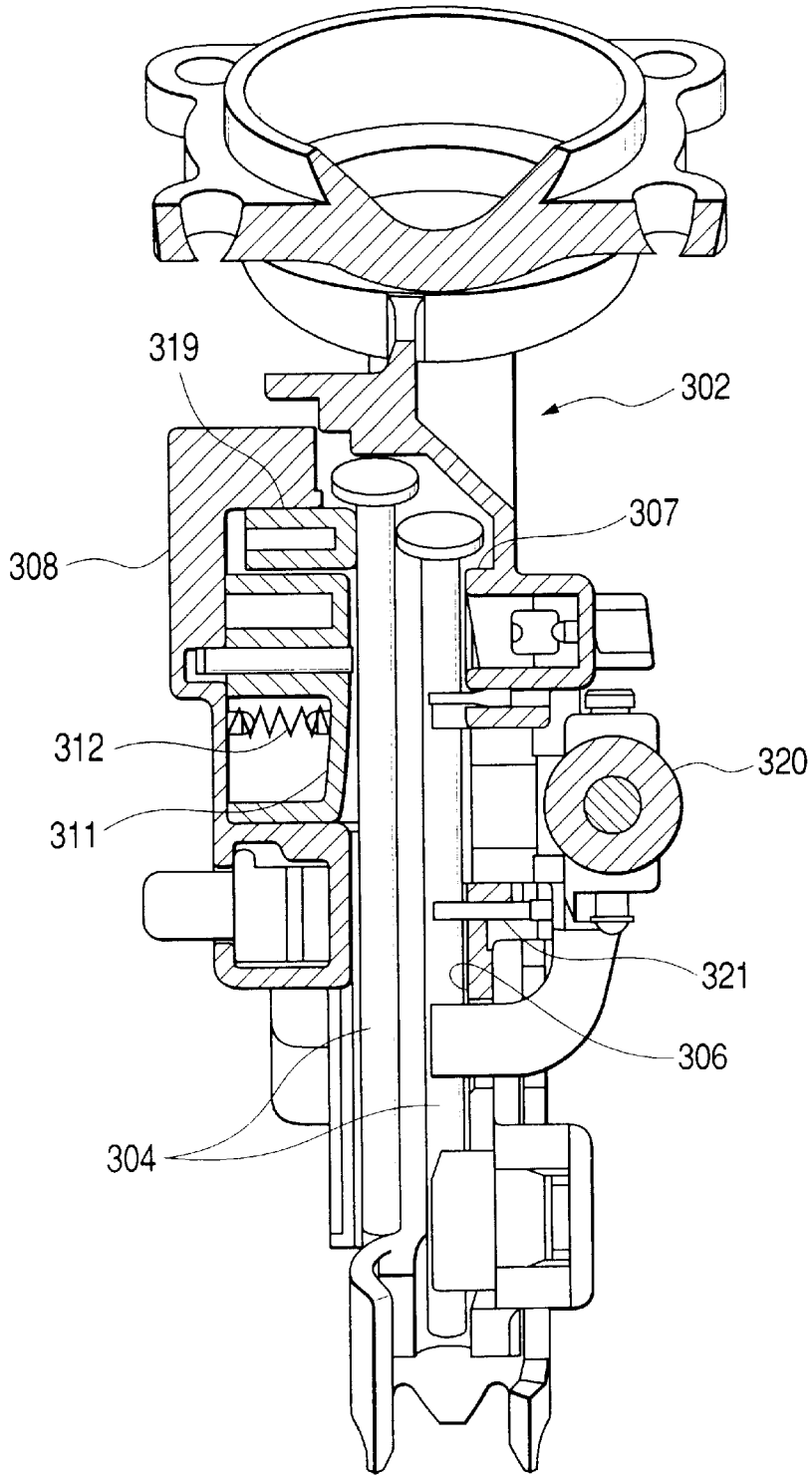
FIG. 28 is a cross sectional view taken on line XI—XI in FIG. 26.

FIG. 26 is a side view showing a lower part of a nailing machine constructed according to the present invention. FIG. 27 is a cross sectional view taken on line X—X in FIG. 26. FIG. 28 is a cross sectional view taken on line XI—XI FIG. 26.

In the figures, reference numeral 301 designates a nose portion. The nose portion 301 is provided at the front end of a main body (not shown) of a nailing machine, and includes a nail ejection opening 302*a* which slidably contains a driver 302 to be driven by compressed air or the like in the nailing machine main body (machine main body). A connected nail assembly 304, which has been loaded into a magazine 303, is fed to a nail ejection opening 302*a*, and driven out through the tip of the nose portion 301 by means of the driver 302. The connected nail assembly 304 consists of a series of nails being linearly arrayed in straight.

A nail introducing opening 305 is formed in a side of the nail ejection opening 302*a*. A nail guide surface 306 (a planar shape) is extended linearly and continuously from the nail introducing port 305. The nail guide surface 306 includes a shoulder 307 for supporting nail heads of the connected nail assembly 304.

A door 308 (opening/closing guide member) and a movable guide wall 309 are oppositely disposed with respect to the nail guide surface 306, while being separated from each other by a predetermined distance.

The door 308 of the known type is supported on a shaft 310 disposed along the nose portion 301, in a state that it is horizontally turned about the shaft. A first pressing portion, which is divided into upper part and lower part (a first pressing member 311), is disposed on the inner side of the door, and is urged and pressed against the nail guide surface 306 by means of a spring 312. Reference numeral 313*a* is a check pawl. A slanted guide portion 314 is provided on a rear part of the first pressing member 311.

The movable guide wall 309 is disposed adjacent to the door 308. The movable guide wall 309 may vertically be turned about a support shaft 315, which is disposed in an upper part of the magazine main body 303*a*. A second pressing portion 316, which is divided into upper and lower parts, is disposed on the inner side of the movable guide wall 309, and the second pressing portion 316 is urged and pressed against the nail guide surface 306 by means of a spring 317. The second pressing portion 316 constitutes pressing means together with the first pressing portion including the first pressing member 311. A slanted guide part 318 is provided on a rear part of the second pressing portion 316. The movable guide surface 309 includes a head-supporting member 319 (upper part of the first pressing portion) for supporting the nail heads of the connected nail assembly 304 (see FIG. 28).

A cutout 323 is formed in the movable guide wall 309. The cutout 323 extends from the rear end of the magazine 303 to be loaded with the connected nail assembly to the nail ejection opening. The inside of the magazine is viewed through the cutout 323.

Accordingly, the door 308 and the movable guide wall 309, together with the first pressing portion, including a first pressing member 311, and the second pressing portion 316, are respectively turned, for opening and closing, about the shafts 310 and 315 between a position opposed to the nail guide surface 306 of the magazine 303 and a position to open the nail guide surface 306. The door 308 and the movable guide wall 309 may mutually be locked with locking means 324, and are not released till the locking state is removed.

Figure 29:
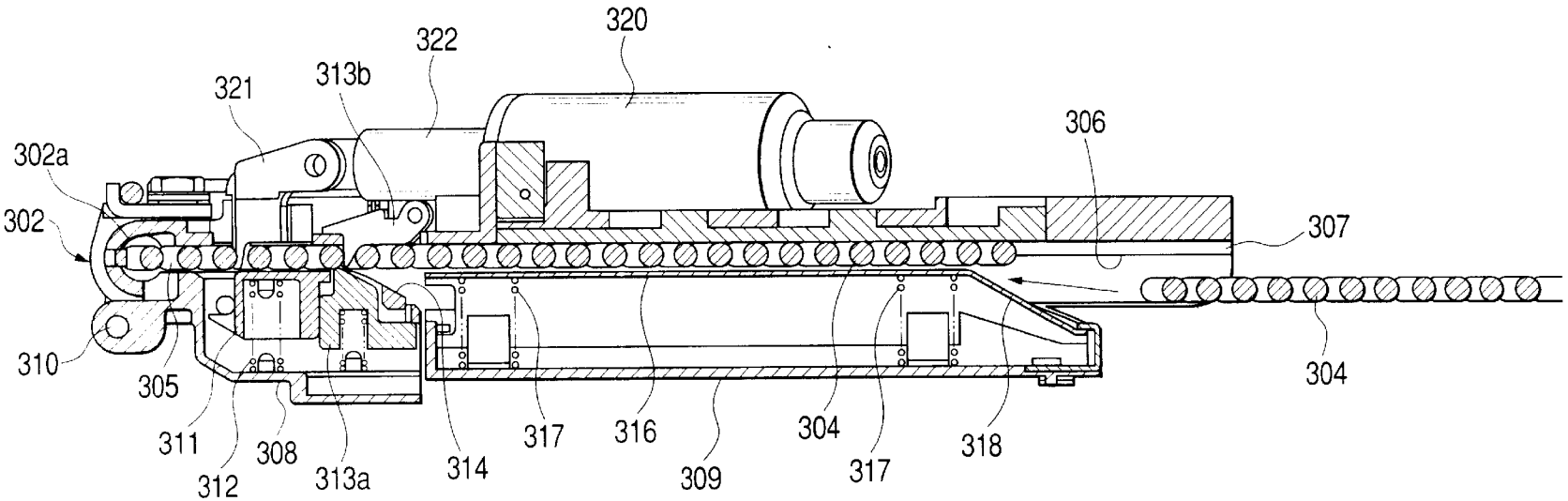
FIG. 29 is a diagram showing how a connected nail assembly is loaded into the nailing machine.

To load the connected nail assembly 304 into the thus constructed magazine 303, the connected nail assembly 304 is inserted into the magazine 303, from the rear end of the magazine, as shown in FIG. 29. In the loading, the front end of the connected nail assembly 304 hits the rear end of the second pressing portion 316 of the movable guide wall 309. It presses back the second pressing portion 316 and advances into the inside of the magazine. Also for the door 8, it may be loaded along the nail guide surface 6 while pressing back the first pressing portion including the first pressing member 311. Within the magazine 3, two sheets of connected nail assemblies 304 are juxtaposed in a state that the heads of those connected nail assemblies 304 partially overlap (FIGS. 27 and 28). The heads of those connected nail assemblies 304 are slidably supported on the shoulder 307 and the head-supporting member 319, which are respectively formed on the nail guide surface 306 and the movable guide wall 309. The first pressing portion, including the first pressing member 311, and the second pressing portion 316 which are located closer to the door 308 and the movable guide wall 309, support the connected nail assembly 304 while pressing them to the nail guide surface 306.

The cutout 323 is formed in the movable guide wall 309. Therefore, even when a connected nail assembly whose nails are short, e.g., a connected nail assembly taken out of the magazine 303 during the driving work, is loaded into the magazine, the rear end of the connected nail assembly may forcibly be pushed forward by manual operation by inserting the user's finger through the cutout 323.

A nail feeder 320 including a piston/cylinder mechanism utilizing a compressed air is disposed on the rear side of the nail guide surface 306. In the nail feeder, the piston moves forward; the nail feeding member 21 that is rotatably coupled to the piston rod 322 comes in engagement with the nail shank of the connected nail assembly 304; feeds the nail to the nose part side; and feeds the foremost nail of the connected nail assembly 304 to the nail introducing opening 305. When the nail feeding member 321 moves backward, the nail feeding member disengages from the connected nail assembly 304 and returns to is initial position. Accordingly, the foremost nail of the connected nail assembly 304 is moved to the nail introducing port 305 every movement of the piston back and forth. When the connected nail assembly 304 located closer to the nail guide surface 306 is fed to the last, the other connected nail assembly 304 is pressed by the first pressing portion and the second pressing portion 316 to slide toward the nail guide surface 306, and this connected nail assembly 304 is subsequently driven. Incidentally, reference numeral 313*b* designates a check pawl.

In a case where to replace the current connected nail assembly with another connected nail assembly whose size is different from the former during the nailing work, the connected nail assembly 304 located closer to the nail guide surface 306 is removed, the movable guide wall 309 (and the door 308) is turned about the support shaft 315 (310) to open the magazine 303, and the user accesses the remaining connected nail assembly 304 through the opened place, and manually pulls the connected nail assembly to the rear side of the magazine 303, and out of there. When the remainder of the connected nail assembly 304 located close to the nail guide surface is reduced in amount, and a new connected nail assembly is loaded and placed close to the one, the movable guide wall 309 is opened and the new connected nail assembly 304 is loaded and placed close to the side of the old one 304. After loading, the movable guide wall 309 is closed.

As described above, in the connected nail supplying mechanism thus constructed, the cutout 323 is formed in the movable guide wall 309. Therefore, even when a connected nail assembly whose nails are short is loaded into the magazine 303 from the rear end of the magazine, the rear end of the connected nail assembly may forcibly be pushed forward by manual operation by inserting the user's finger through the cutout 323. Accordingly, the foremost nail of the connected nail assembly is reliably located at a position within a reciprocating operation range of the feeding member even if the number of nails of the connected nail assembly is reduced. Accordingly, the connected nail supplying mechanism of the invention succeeds in solving the problem of nail supplying failure such that the connected nail assembly 304 is imperfectly loaded and the shank of the foremost nail of the connected nail assembly fails to engage the nail feeding member.

Another cutout may be formed in a side wall of the nail guide surface 306. By so doing, the user may insert his two fingers into the magazine through the cutouts of both sides, and nip the connected nail assembly with the two fingers. Accordingly, the loading operation of the connected nail assembly is easy. The cutout may be formed in the box type magazine not having the movable guide wall.

Figure 30:
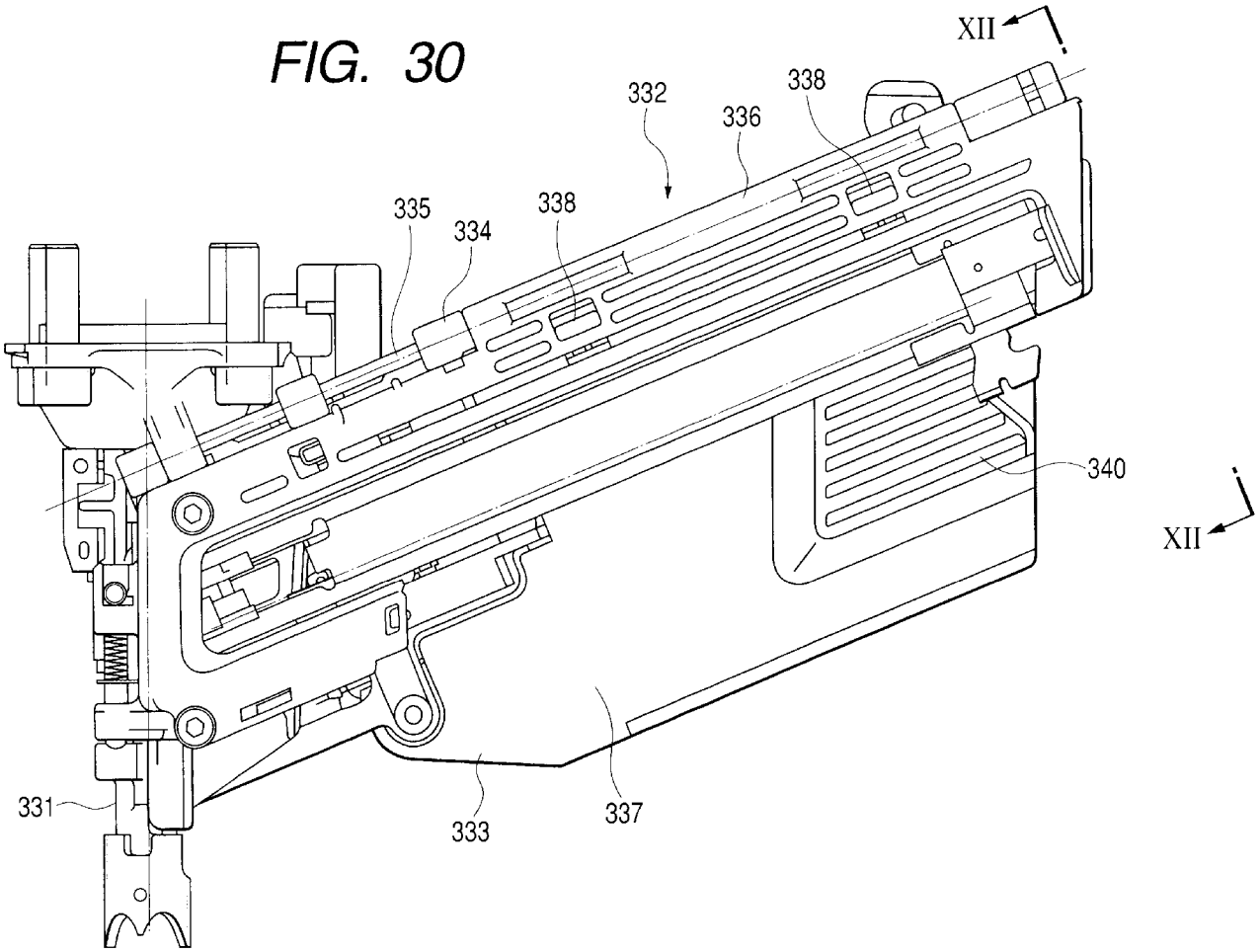
FIG. 30 is a side view showing a nose and a magazine in the nailing machine.
Figure 31:
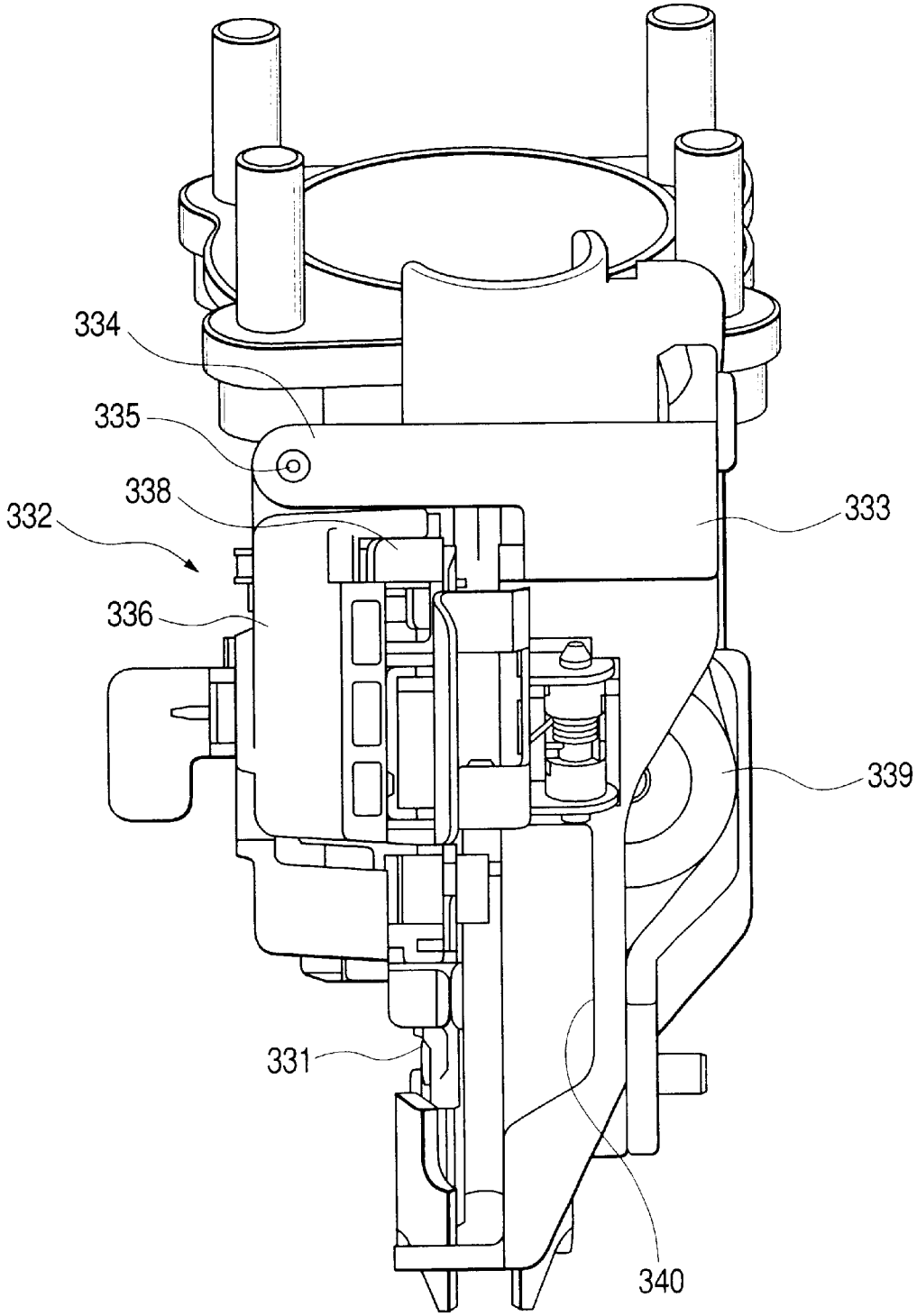
FIG. 31 is a perspective view showing the structure in FIG. 30 when viewed in a direction of XI—XI in FIG. 30.

FIGS. 30 and 31 show another embodiment of the invention. In the figures, reference numeral 331 is a nose part and numeral 332 is a magazine. The nose part 331 is coupled to the tip top of a cylinder housing (not shown) of a nailing machine body by means of bolts. The magazine 332 is coupled to the rear side of the nose part 331, and two sheets of connected nail assemblies may be loaded into the magazine 332 while being arranged in a juxtaposing fashion.

As shown in FIG. 31, a bracket portion 334 extends to the left from the upper part of a right frame 333 of the magazine 332. A left cover 336 is mounted on a support shaft 335 that is provided on the bracket portion 334. Accordingly, when the locking mechanism is released and the left cover 336 is pulled up, the nail guide surface 337 of the right frame 333 is fully exposed to outside.

Provided within the upper part of the left cover 336 are a pressing member 338 and a pressing mechanism using a spring (not shown). A connected nail assembly that has been inserted into the magazine 332 from its rear end is pressed against the nail guide surface 337 of the right frame 333 by means of the pressing member 338. An air cylinder 339 for the nail feeder is located on the right side surface, as in the magazine 303 of FIG. 26. A feeding pawl (not shown) of the air cylinder 339 comes in engagement with a connected nail assembly being in contact with the nail guide surface 337 within the right frame 333, and feeds it forward, and the foremost nail of the connected nail assembly is loaded into the nose part 331.

A recess 340 is formed in the nail guide surface 337 of the right frame 333, while extending from the rear end to the mid position as viewed in the front and back directions. The user may insert his finger into the recess 340, from the rear side of the magazine 332. The recess 340 is located at a mid position of the connected nail assembly as vertically viewed. Gaps, each being so sized as to allow the user to insert his finger thereinto, are present between the mid position of the connected nail assembly held contacting with the nail guide surface 337 and the recess 340. Accordingly, to reload into the magazine the connected nail assembly that is taken out from the magazine during its use and hence is reduced in its longitudinal size, the user inserts the connected nail assembly into the magazine 332 from its rear side, and inserts his finger to the recess 340 and moves forward the connected nail assembly till the feeding nail of the nail feeder reaches the connected nail assembly. Thus, the connected nail assembly whose longitudinal size is reduced may easily be loaded into the magazine as in the magazine of FIG. 26.

As seen from the foregoing description, in the connected nail supplying mechanism of the invention, a cutout is formed in the side surface of the magazine or a recess is formed in the nail guide surface. With this feature, when the connected nail assembly whose longitudinal length is shortened is loaded into the magazine, the connected nail assembly is further moved beyond the rear end of the magazine with the finger or fingers till the foremost nail of the connected nail assembly reaches a position within the reciprocating operation range of the nail feeding member. Accordingly, the connected nail assembly may easily be loaded into the magazine irrespective of the length of the connected nail assembly.

While only certain embodiments of the invention have been specifically described herein, it will be apparent that numerous modifications may be made thereto without departing from the spirit and scope of the invention.

What is claimed is:

1. A supply mechanism for a connected nail assembly in a nailing machine including a driver for driving a nail of the connected nail assembly and a nose portion having a nail ejection opening and accommodating the driver, said supply mechanism comprising:

a magazine including a nail guide surface having a shoulder connected to the nail ejection opening of the nose portion for supporting nail heads of the connected nail assembly, and a guide wall confronted with said nail guide surface; and a pressing portion provided on said guide wall and confronted with said nail guide surface for pressing the connected nail assembly against said nail guide surface, wherein a plurality of the connected nail assemblies are loaded and placed in parallel, while being in contact with each other, along said nail guide surface, and wherein a cutout is formed in said guide wall of said magazine and extends in a direction from a rear end of said magazine to be loaded with the connected nail assembly to the nail ejection opening.

2. A supply mechanism for a connected nail assembly in a nailing machine including a driver for driving a nail of the connected nail assembly and a nose portion having a nail ejection opening and accommodating the driver, said supply mechanism comprising:

a magazine including a nail guide surface having a shoulder connected to the nail ejection opening of the nose portion for supporting nail heads of the connected nail assembly, and a guide wall confronted with said nail guide surface; and a pressing portion provided on said guide wall and confronted with said nail guide surface for pressing the connected nail assembly against said nail guide surface, wherein a plurality of the connected nail assemblies are loaded and placed in parallel, while being in contact with each other, along said nail guide surface, and wherein a recess is formed in said nail guide surface of said magazine and extends in a direction from a rear end of said magazine to be loaded with the connected nail assembly to the nail ejection opening.

3. A supply mechanism for a connected nail assembly in a nailing machine including a driver for driving a nail of the connected nail assembly and a nose portion having a nail ejection opening and accommodating the driver, said supply mechanism comprising:

a magazine including a nail guide surface having a shoulder connected to the nail ejection opening of the nose portion for supporting nail heads of the connected nail assembly, and a movable guide wall confronted with said nail guide surface; and a first pressing portion provided on said movable guide wall and confronted with said nail guide surface for pressing the connected nail assembly against said nail guide surface, wherein a plurality of the connected nail assemblies are loaded and placed in parallel, while being in contact with each other, along said nail guide surface, and wherein said movable guide wall is movable between a position confronted with said nail guide surface of said magazine and a position at which said nail guide surface is opened.

4. The supply mechanism according to claim 3, wherein a cutout is formed in said movable guide wall of said magazine and extends in a direction from a rear end of said magazine to be loaded with the connected nail assembly to the nail ejection opening.

5. The supply mechanism according to claim 3, wherein a recess is formed in said nail guide surface of said magazine and extends in a direction from a rear end of said magazine to be loaded with the connected nail assembly to the nail ejection opening.

6. The supply mechanism according to claim 3, wherein said first pressing portion includes:

a first pressing member coming in contact with a nail shank of the connected nail assembly for pressing the connected nail assembly to said nail guide surface; and a first head-supporting member for supporting nail heads of the connected nail assembly when engaging the under side of the nail heads of the connected nail assembly, wherein an operation stroke of said first head-supporting member moving to said nail guide surface is restricted.

7. The supply mechanism according to claim 3, further comprising:

an opening/closing guide member supported on the nose portion in an opening/closing fashion, and confronted with a fixed guide surface of the nose portion, wherein the fixed guide surface is continuous to the nail ejection opening of the nose portion.

8. The supply mechanism according to claim 7, further comprising:

a second pressing portion provided on said opening/closing guide member and confronted with said nail guide surface for pressing the connected nail assembly against said nail guide surface.

9. The supply mechanism according to claim 8, wherein said second pressing portion includes:

a second pressing member coming in contact with a nail shank of the connected nail assembly for pressing the connected nail assembly to said nail guide surface; and a second head-supporting member for supporting nail heads of the connected nail assembly when engaging the under side of the nail heads of the connected nail assembly, wherein an operation stroke of said second head-supporting member moving to said nail guide surface is restricted.

10. The supply mechanism according to claim 9, further comprising:

a slanted guide surface provided above the nail is heads of one of the connected nail assemblies loaded into said magazine, wherein when the connected nail assembly is pressed and moved to said nail guide surface by said first pressing portion and said second pressing portion, the support of the under side of the nail heads by said first head-supporting member and said second head-supporting member is removed, and the connected nail assembly is guided downward by said slanted guide surface.

11. A supply mechanism for a connected nail assembly in a nailing machine including a driver for driving a nail of the connected nail assembly and a nose having a nail ejection opening and accommodating the driver, said supply mechanism comprising:

a magazine including a nail guide surface having a shoulder connected to the nail ejection opening of the nose portion for supporting nail heads of the connected nail assembly;

a check pawl engaging nails of a first connected nail assembly disposed along said nail guide surface for blocking the backward movement of the connected nail assembly; and a pressing portion confronted with said nail guide surface for pressing against said nail guide surface, said pressing portion including a seizing pawl member engaging nails of a second connected nail assembly placed in parallel with the first connected nail assembly for blocking backward movement of the second connected nail assembly, and a nail head support disposed on said pressing member and provided at a higher position than an upper end of said nail guide surface.

12. The supply mechanism according to claim 11, wherein a rear end of said pressing portion is positioned ahead a rear end of said magazine.

13. The supply mechanism according to claim 11, further comprising:

a nail feeding member passing through a fixed guide wall of the nose portion and reciprocatively moving for engaging one of the nails of the first connected nail assembly disposed along said nail guide surface and supplying the nails to the nail ejection opening.

14. The supply mechanism according to claim 13, further comprising:

a stopping face for stopping the second connected nail assembly at a position at which a nail shank of a foremost nail of the second connected nail assembly is positioned ahead of said seizing pawl member, wherein said seizing pawl member is located ahead a rear end of a reciprocating stroke of said nail feeding member.

* * * * *